US011530572B2

(12) United States Patent
Flannery et al.

(10) Patent No.: US 11,530,572 B2
(45) Date of Patent: Dec. 20, 2022

(54) MINIMIZED GATE

(71) Applicant: Regalo International, LLC, Longboat Key, FL (US)

(72) Inventors: Mark A. Flannery, Longboat Key, FL (US); Gary T. Schultze, Savage, MN (US); Timothy C. Daggy, Shakopee, MN (US); Nicholas E. Beattie, Saint Paul, MN (US); Matthew A. Willms, Woodbury, MN (US); Michael P. Lane, Chaska, MN (US)

(73) Assignee: Regalo International, LLC, Longboat Key, FL (US)

( * ) Notice: Subject to any disclaimer, the term of this patent is extended or adjusted under 35 U.S.C. 154(b) by 100 days.

(21) Appl. No.: 17/187,800

(22) Filed: Feb. 27, 2021

(65) Prior Publication Data

US 2021/0180398 A1 Jun. 17, 2021

Related U.S. Application Data

(63) Continuation of application No. 16/021,031, filed on Jun. 28, 2018, now Pat. No. 10,934,769.

(60) Provisional application No. 62/526,349, filed on Jun. 28, 2017.

(51) Int. Cl.

| | |
|---|---|
| ***E06B 3/68*** | (2006.01) |
| ***E06B 9/06*** | (2006.01) |
| ***E06B 11/02*** | (2006.01) |
| ***E06B 9/04*** | (2006.01) |
| *E06B 9/00* | (2006.01) |

(52) U.S. Cl.

CPC ..... *E06B 9/06* (2013.01); *E06B 9/04* (2013.01); *E06B 11/02* (2013.01); *E06B 2009/002* (2013.01)

(58) Field of Classification Search

CPC ..... E06B 9/04; E06B 2009/002; E06B 9/06; E06B 11/02

USPC ..... 49/50, 55, 57

See application file for complete search history.

(56) References Cited

U.S. PATENT DOCUMENTS

| | | | |
|---|---|---|---|
| 3,667,788 | A | 6/1972 | Greenwood |
| 4,154,545 | A | 5/1979 | Pinto et al. |
| 4,508,467 | A | 4/1985 | Choffin |
| 4,607,455 | A | 8/1986 | Bluem et al. |
| 4,624,072 | A | 11/1986 | Zilkha |
| 4,628,635 | A | 12/1986 | Maillard |
| 5,131,186 | A | 7/1992 | Lamont |
| 5,797,218 | A | 8/1998 | Holland |
| 6,178,693 | B1 | 1/2001 | Hunt |
| 6,233,874 | B1 | 5/2001 | Johnson |

(Continued)

FOREIGN PATENT DOCUMENTS

| | | | |
|---|---|---|---|
| WO | 9014489 | A | 11/1990 |

OTHER PUBLICATIONS

ISA/US, Notification Of Transmittal Of The International Search Report And The Written Opinion Of The International Searching Authority, Or The Declaration, dated Sep. 21, 2018, PCT/US2018/040112, ISA/US, Alexandria, Virginia, United States of America.

(Continued)

*Primary Examiner* — Jerry E Redman

(57) ABSTRACT

A barrier having a gate and a frame where each of the frame and gate is reduced in at least one of a height and length dimension so as to be shipped and stored in a box of minimal size.

3 Claims, 21 Drawing Sheets

(56) References Cited

U.S. PATENT DOCUMENTS

| | | | | |
|---|---|---|---|---|
| 6,302,614 | B1 | 10/2001 | Tseng | |
| 6,427,396 | B1 | 8/2002 | Harrison | |
| 7,887,029 | B2 | 2/2011 | Flannery | |
| 7,975,431 | B2 | 7/2011 | Flannery | |
| 8,196,348 | B2 | 6/2012 | Flannery | |
| 8,898,957 | B2 | 12/2014 | Morrone, III | |
| 9,382,740 | B2 * | 7/2016 | Flannery | E05D 7/10 |
| 9,382,750 | B1 * | 7/2016 | Flannery | E05C 3/16 |
| 9,388,837 | B1 | 7/2016 | Hanley | |
| 9,689,197 | B1 | 6/2017 | Flannery | |
| 9,874,055 | B1 * | 1/2018 | Flannery | E06B 11/02 |
| 10,415,290 | B1 * | 9/2019 | Flannery | E06B 9/02 |
| 10,450,795 | B2 * | 10/2019 | Raffi | E05B 65/0007 |
| 10,934,769 | B2 * | 3/2021 | Flannery | E06B 9/04 |
| 11,035,173 | B1 * | 6/2021 | Flannery | E05D 7/08 |
| 11,041,340 | B1 * | 6/2021 | Flannery | E05C 1/16 |
| 11,072,973 | B2 * | 7/2021 | Flannery | E06B 9/04 |
| 11,085,233 | B1 * | 8/2021 | Flannery | E05F 1/068 |
| 11,111,719 | B1 * | 9/2021 | Flannery | E06B 3/26 |
| 2002/0157316 | A1 | 10/2002 | Andersen | |
| 2005/0028947 | A1 | 2/2005 | Waldman | |
| 2007/0017156 | A1 | 1/2007 | Robinson | |
| 2007/0074453 | A1 | 4/2007 | Flannery | |
| 2009/0277092 | A1 | 11/2009 | Dochtermann, III | |
| 2009/0293363 | A1 | 12/2009 | Flannery | |
| 2012/0155950 | A1 | 6/2012 | Donohue | |
| 2012/0174507 | A1 | 7/2012 | Burger | |
| 2012/0233922 | A1 | 9/2012 | Flannery | |
| 2013/0160365 | A1 * | 6/2013 | Flannery | E05C 1/10 49/50 |
| 2015/0101250 | A1 | 4/2015 | Marsden | |
| 2016/0017906 | A1 | 1/2016 | Bertrand et al. | |
| 2017/0211314 | A1 | 7/2017 | Raffi | |
| 2019/0360268 | A1 * | 11/2019 | Flannery | E06B 3/52 |
| 2021/0180398 | A1 * | 6/2021 | Flannery | E06B 9/06 |
| 2022/0127907 | A1 * | 4/2022 | Flannery | E06B 11/027 |

OTHER PUBLICATIONS

ISA/US, International Search Report, dated Sep. 21, 2018, PCT/US2018/040112, ISA/US, Alexandria, Virginia, United States of America.

ISA/US, Written Opinion Of The International Searching Authority, dated Sep. 21, 2018, PCT/US2018/040112, ISA/US, Alexandria, Virginia, United States of America.

WIPO, Notification Concerning Transmittal Of International Preliminary Report On Patentability dated Jan. 9, 2020 (one page) in PCT/US2018/040112, Geneva, Switzerland.

WIPO, International Preliminary Report On Patentability dated Dec. 31, 2019 (six pages) in PCT/US2018/040112, Geneva, Switzerland.

* cited by examiner 364
366
365
338
358
360
362
372
370
376
386
390
388
340
380
382
404
384
392
402
400
398
378
526
342
344
528

MINIMIZED GATE

This application is a continuation of U.S. patent application Ser. No. 16/021,031 filed Jun. 28, 2018 (U.S. Pat. No. 10,934,769 issued Mar. 2, 2021) and claims the benefit thereof under 35 U.S.C. § 120, which application claims the benefit under 35 U.S.C. 119(e) of U.S. Provisional Patent Application No. 62/526,349 filed Jun. 28, 2017, with such applications being hereby incorporated by reference in their entireties into this application.

FIELD OF THE INVENTION

The present invention relates to a barrier having a frame and a gate, and more particularly to a barrier having a frame and a gate where each of the frame and gate are reducible in at least one of the height and length dimension.

BACKGROUND OF THE INVENTION

At some times it may be preferable to deliver a product to an end user in an already assembled form. At other times it may be preferable to place a premium on size and space during shipment from the manufacturer to the distributor, during storage at a warehouse, and when on the shelf at a retail store.

SUMMARY OF THE INVENTION

A feature of the present invention is the provision in a gated barrier, of a frame having a first end and a second end and a cross piece traversing the first and second ends, of a gate in the frame where the gate confronts the first end, the second end, and the cross piece, of the frame being reducible in at least one of the height and length dimension, and of the gate being reducible in at least one of the height and length dimension.

Another feature of the present invention is the provision in such a gated barrier, of the frame being reducible in each of the length and height dimension.

Another feature of the present invention in the provision in such a gated barrier, of the gate being reducible in each of the length and height dimension.

Another feature of the present invention is the provision in such a gated barrier, of the gate including a first gate unit and a second gate unit.

Another feature of the present invention is the provision in such a gated barrier, of the first and second gate units being removably engagable to each other.

Another feature of the present invention is the provision in such a gated barrier, of the frame including a first frame unit, a second frame unit, a third frame unit, and a fourth frame unit.

Another feature of the present invention is the provision in such a gated barrier, of the first frame unit including a first vertically extending piece, where the first gate unit is swingably engagable to the first frame unit.

Another feature of the present invention is the provision in such a gated barrier, of the second frame unit including a second vertically extending piece, where the first gate unit is latchably engagable to the second frame unit.

Another feature of the present invention is the provision in such a gated barrier, of the third frame unit including a first L-shaped piece, where the first L-shaped piece is removably engagable to the first frame unit, and where the second gate unit is swingably engagable to the third frame unit.

Another feature of the present invention is the provision in such a gated barrier, of the fourth frame unit including a second L-shaped piece, where the second L-shaped piece is removably engagable to the first L-shaped piece and removably engagable to the second frame unit.

Another feature of the present invention is the provision in such a gated barrier, of the first end of the frame including the first frame unit and a portion of the third frame unit, of the second end of the frame including the second frame unit and a portion of the fourth frame unit, of the cross piece of the frame including a portion of the third frame unit, and of the cross piece of the frame including a portion of the fourth frame unit.

Another feature of the present invention is the provision in such a gated barrier, of the first gate unit including a first lowermost traversing gate support member, a first uppermost traversing gate support member, a first left end upright gate support member, a first right end upright gate support member, and at least one first interior upright gate support member disposed between the first left end upright gate support member and the first right end upright gate support member.

Another feature of the present invention is the provision in such a gated barrier, of the second gate unit including a second lowermost traversing gate support member, a second uppermost traversing gate support member, a second left end upright gate support member, a second right end upright gate support member, and at least one second interior upright support member disposed between the first left end upright gate support member and the first right end upright gate support member.

Another feature of the present invention is the provision in such a gated barrier, of the first and second gate units being removably engagable to each other such that the first and second gate units define a plane.

Another feature of the present invention is the provision in such a gated barrier, of the first and second gate units being removably engagable to each other by the first lowermost traversing gate support member of the first gate unit and the second uppermost traversing gate support member of the second gate unit being removably engagable to each other.

Another feature of the present invention is the provision in such a gated barrier, of the first left end upright gate support member of the first gate unit and the second left end upright gate support members of the second gate unit defining a swing axis for the gate.

Another feature of the present invention is the provision in such a gated barrier, of the first left end upright gate support member of the first gate unit confronting the first frame unit when the gate is open and when the gate is closed.

Another feature of the present invention is the provision in such a gated barrier, of the second left end upright gate support member of the second gate unit confronting the third frame unit when the gate is open and when the gate is closed.

Another feature of the present invention is the provision in such a gated barrier, of the first right end upright gate support member of the first gate unit confronting the second frame unit when the gate is closed.

Another feature of the present invention is the provision in such a gated barrier, of second right end upright gate support member of the second gate unit confronting the fourth frame unit when the gate is closed.

Another feature of the present invention is the provision in such a gated barrier, of the second lowermost traversing gate support member of the second gate unit confronting each of the first L-shaped piece of the third frame unit and the second L-shaped piece of the fourth frame unit when the gate is closed.

Another feature of the present invention is the provision in such a gated barrier, of the gate being reducible in the height dimension.

Another feature of the present invention is the provision in such a gated barrier, of a first frame extension, where the first frame extension includes a first upper extension unit and a first lower extension unit, where the first upper and lower extension units are engagable to each other, where the first upper extension unit is engagable to the first frame unit, and where the first lower extension unit is engagable to the third frame unit.

Another feature of the present invention is the provision in such a gated barrier, of a second frame extension, where the second frame extension includes a second upper extension unit and a second lower extension unit, where the second upper and lower extension units are engagable to each other and where the second upper extension unit is engagable to the first frame unit, and where the second lower extension unit is engagable to the third frame unit.

Another feature of the present invention is the provision in such a gated barrier, of the first vertically extending piece being a first inner vertically extending piece, where the first frame unit further includes a first outer vertically extending piece and where the first inner vertically extending piece includes a width greater than the first outer vertically extending piece.

Another feature of the present invention is the provision in such a gated barrier, of the second vertically extending piece being a second inner vertically extending piece, where the second frame unit further includes a second outer vertically extending piece, where the second inner vertically extending piece includes a width greater than the second outer vertically extending piece.

Another feature of the present invention is the provision in such a gated barrier, of the first frame unit further including a first lowermost traversing frame support member, where the third frame unit further includes a third uppermost traversing frame support member and where the first and third frame units are removably engagable to each other by the first lowermost traversing frame support member and the third uppermost traversing frame support member being removably engagable to each other.

Another feature of the present invention is the provision in such a gated barrier, of the second frame unit further including a second lowermost traversing frame support member, where the fourth frame unit further includes a fourth uppermost traversing frame support member and where the second and fourth frame units are removably engagable to each other by the second lowermost traversing frame support member and the fourth uppermost traversing frame support member being removably engagable to each other.

An advantage of the present invention is that the gated barrier, when disassembled, can fit in an Amazon tote.

Another advantage of the present invention is that, when assembled, the gated barrier includes a structure that is strong.

Another advantage of the present invention is that, when assembled, the gated barrier is easy to operate.

Another advantage of the present invention is cost. The present gate barrier is inexpensive—more inexpensive than a conventional gated barrier because the present gate barrier can be shipped at a lesser cost.

Another advantage of the present invention is that the present gated barrier is quickly and easily assembled.

Another advantage of the present invention is that the present gated barrier is quickly and easily disassembled.

Another advantage of the present invention is that the present gated barrier is safe for children and pets.

BRIEF DESCRIPTION OF THE DRAWINGS

FIG. 12A is a front detail perspective view of a portion of the minimizable frame of FIG. 11A.

DESCRIPTION

Figure 1A:
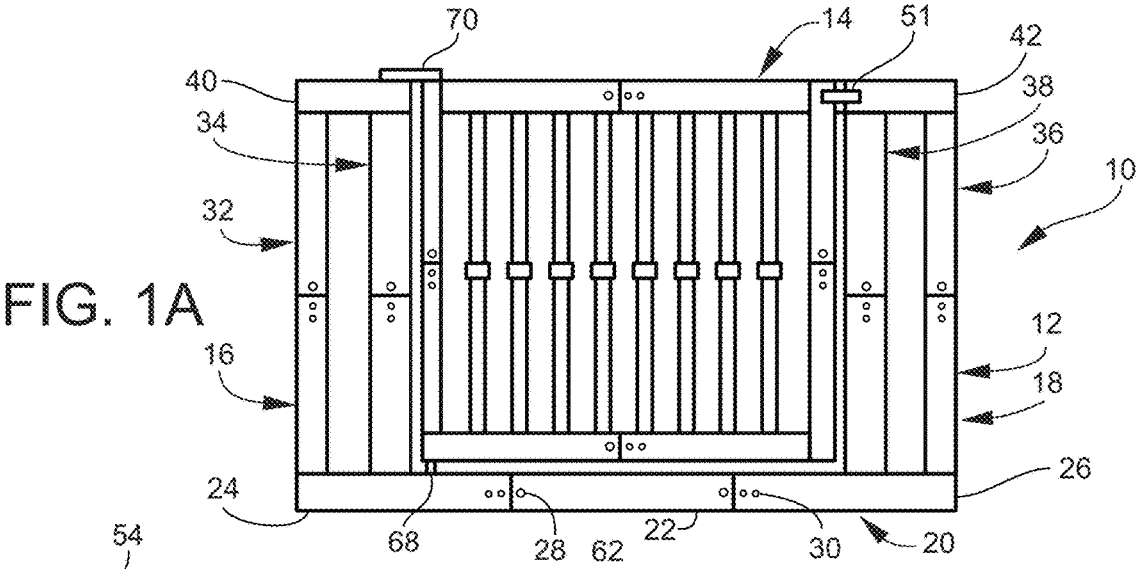
FIG. 1A is a front elevation view of a first embodiment of a minimizable barrier, where the minimizable barrier includes a minimizable gate and a minimizable frame.
Figure 1B:
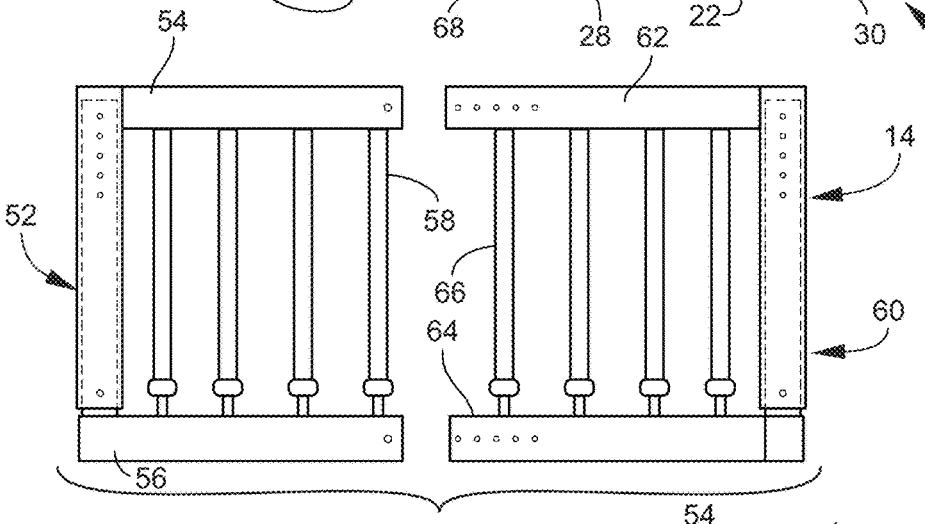
FIG. 1B is a front elevation view of the minimizable gate of FIG. 1B prior to the gate being expanded.
Figure 1C:
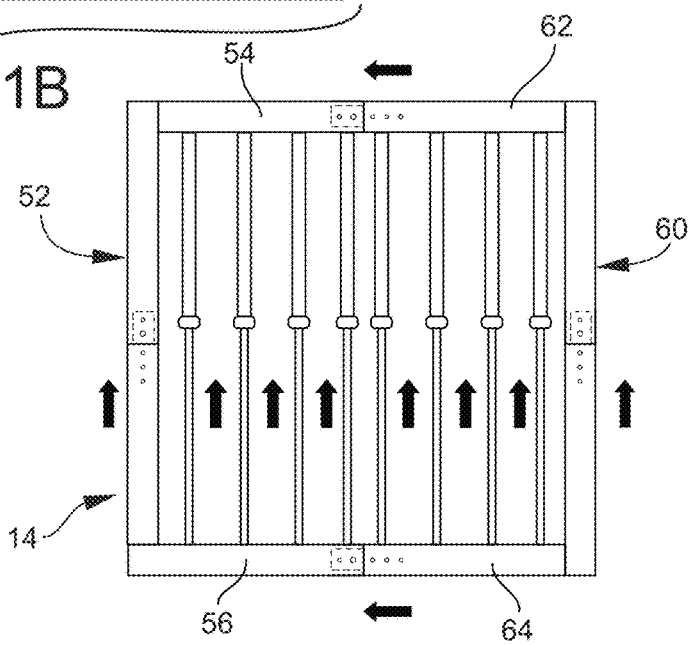
FIG. 1C is a front elevation view of the minimizable gate of FIG. 1C after the gate has been expanded.

FIGS. 1A, 1B, and 1C show elevation views where FIG. 1A shows a frame 12 and a gate 14, and where FIGS. 1B and 1C show the gate 14. The first and second ends 16, 18 of the frame 12 telescope vertically. The first and second ends 16, 18 may be separated from each other by the cross piece 20. The cross piece 20 telescopes horizontally. The cross piece 20 may be disassembled into three pieces, 22, 24, 26. The middle section 22 of the cross piece 20 may telescope into one of the end cross sections 24, 26. The gate 14 telescopes both vertically and horizontally. As shown in FIG. 1B, the gate 14 may be separated into first and second half portions for storage.

FIGS. 1A, 1B, and 1C show elevation views where FIG. 1A shows a minimizable barrier 10 having the minimizable frame 12 and the minimizable gate 14, and where FIGS. 1B and 1C show the minimizable gate 14. The first and second ends 16, 18 of the frame 12 telescope relative to each other vertically. The first and second ends 16, 18 are engaged to each other and are spaced apart from each other by the cross piece or threshold 20. The cross piece 20 may be disassembled into three pieces, the middle section 22, the first end or left section 24, and the second end or left section 26. The cross piece 20 telescopes horizontally. Each of the end cross sections 24, 26 telescopes into the middle section 22. The telescoping movement is fixed with pin connectors 28 engaging pin receptors or openings 30. If desired, the middle section 22 of the cross piece 20 may telescope into one of the end cross sections 24, 26. Or the left end cross section 24 may telescope into the middle cross section 22 that in turn telescopes into the right cross section 26, or section 26 may telescope into section 22 that in turn telescopes into section 24. Such telescoping action fixes the width of the U-shaped open top frame 12 into which the gate 14 is engaged and provides an adjustable width such that gates 14 of different width can be engaged therein. Reference number 28 may herein designate a pin connector or an opening for a pin connector.

The U-shaped open top frame 12 includes the left frame end 16 and the right frame end 18. Left frame end 16 includes an outer upright telescoping support member 32 and an inner upright telescoping support member 34. Right frame end 18 includes an outer upright telescoping support member 36 and an inner upright telescoping support member 38. Each of the members 32, 34, 36, 38 has a lower section and an upper section. The lower section of each of the members 32, 24, 26, 28 slides into or telescopes into the upper section such that the lower section is a male member and the upper section is a female member. Each of the upper sections includes a pin connector 28 that may be engaged with any of several pin receivers 30 in the respective lower section of members 32, 24, 26, 28.

The U-shaped open top frame 12 further includes a left upper cross piece 40 engaging left members 32, 34 and a right upper cross piece 42 engaging right members 36, 38.

In a disassembled form, cross piece 40, members 32, 34, and left cross section 24 make up a unit. In such disassembled form, lower sections of members 32, 34 are received in their respective upper sections so as to minimize the height of such unit. Such unit may or may not include middle threshold section 22, into which left threshold section 24 may slide to minimize a width of such unit.

In a disassembled form, cross piece 42, members 36, 38, and right cross section 26 make up a unit. In such disassembled form, lower sections of members 36, 38 are received in their respective upper sections so as to minimize the height of such unit. Such unit may or may not include middle threshold section 22, into which right threshold section 26 may slide to minimize a width of such unit.

In a disassembled form, middle threshold section 22 may be its own unit, separate and apart from each of the left threshold section 24 and right threshold section 26.

Figure 5A:
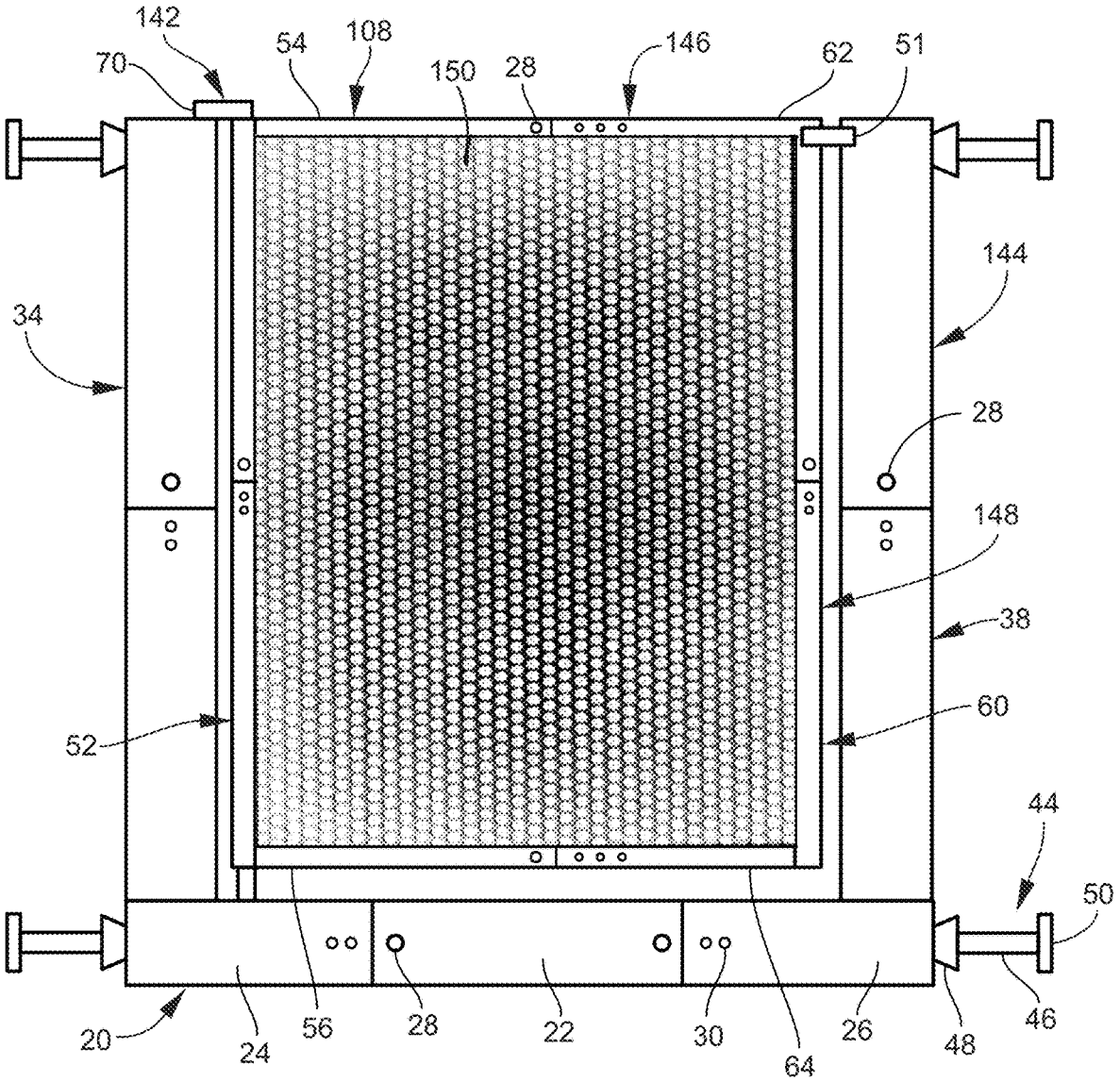
FIG. 5A is a front elevation of a fourth embodiment of a minimizable barrier, where the frame may be minimized according to any of the embodiments herein, and where the gate is minimized by the inclusion of a rolled mesh, where the mesh is rolled out in FIG. 5A, and where the frame of the gate may be minimized according to other embodiments herein, such as the telescoping embodiments of FIG. 1A or the hinged embodiments of FIG. 3A.

The U-shaped open top frame 12 may be a pressure frame. That is, upright support members 32, 34 may be fabricated at an oblique angle relative to threshold cross section 24, such as an obtuse angle. And/or upright support member 36, 38 may be fabricated at an oblique angle relative to threshold cross section 26, such as an obtuse angle. An oblique angle is any angle other than a ninety degree angle and any angle that is not set at a parallel relationship. An obtuse angle is any angle greater than ninety degrees and less than 180 degrees. When engaged to each other through threshold cross piece 22, left frame end 16 and right frame end 18 are oblique relative to each other such that, to relatively push the left frame end 16 into a parallel relationship with right frame end 18, hand wheel mechanisms 44 may be used. Hand wheel mechanism 44 is shown in FIG. 5A and includes a threaded shaft 46, a threaded hand wheel 48 that threadingly engages the threaded shaft 46, and a disk 50 may be pivotally fixed to the distal end of the threaded shaft 46. A proximal end portion of the threaded shaft 46 is received in a horizontal bore having an open end at the outer end of lower right cross piece 26. Another horizontal bore is formed in the lower left cross piece 24 and has an open end in the outer end of lower left cross piece 24. Another horizontal bore is formed in upper left cross piece 40 and has an open end in the outer end of upper left cross piece 40. Another horizontal bore is formed in upper right cross piece 42 and has an open end in the outer end of upper right cross piece 42. Barrier 10 thus may include four hand wheel mechanisms 44, a right upper hand wheel mechanism 44 engaging cross piece 42, a left upper hand wheel mechanism 44 engaging cross piece 40, a left lower hand wheel mechanism 44 engaging cross piece 24, and a right lower hand wheel mechanism 44 engaging cross piece 26. The threaded shaft 46 may slide into and out of the usually unthreaded horizontal bore. When the hand wheel mechanism 44 is set between the barrier 10 and a vertical surface such as a door jamb, the disk 50 is limited in travel by the door jamb and thus the hand wheel 46 when turned exerts pressure on the respective cross piece 24, 26, 40, or 42, thereby relatively pushing in especially upper cross pieces 40, 42 to push one or more of the left end and right end 18 into a right angle relationship with one or more of the threshold cross pieces 22, 24, and 26 and/or until a first portion of a latch mechanism 51 is in position to interact with and engage a second portion of a latch mechanism 51, where the first portion of the latch mechanism 51 is engaged to gate 14 and the second portion of the latch mechanism 51 is engaged to the right frame end 18, and where the gate 14 swings on an end adjacent to the left frame end 16, as shown in FIG. 1A. As a pressure gate 10, when hand wheel mechanisms 44 have been fully engaged, barrier 10 may or may not be disposed off the floor such that the underside of threshold cross piece 20 is spaced from the floor.

When out of the right angle relationship and when in the right angle relationship left frame end 16, right frame end 18, and threshold cross piece 20 are co-planar.

Frame 12 of barrier 10 is minimizable in height because the upper and lower sections of upright members 32, 34, 36, and 38 can be telescoped, as indicated above. Frame 12 of barrier 10 is also minimizable in width because cross piece 22 can be telescoped with either or both of cross pieces 24 and 26.

Gate 14 of barrier is also minimizable in height and width.

Gate 14 includes a left end upright support member 52, a left end upper cross piece 54, a left end lower cross piece 56, and a set of four upright interior support members 58. The left end upright support member 52 includes an upper section and a lower section that telescope, with the lower section sliding into the upper section. Each of the four upright interior support members 58 includes an upper section and a lower section that telescope, with the lower section sliding into the upper section. The left end upright support member 52 is engaged to the upper cross piece 54 and to the lower cross piece 56. Each of the interior support members 58 is engaged to the upper cross piece 54 and the lower cross piece 56. Left end upright support member 52, left end upper cross piece 54, left end lower cross piece 56, and the set of four upright interior support members 58 make up a left end unit. The lower section of left end upright support member 52 includes pin receivers 30 and the upper section of left end upright support member 52 includes a pin connector 28 such that the lower and upper sections of support member 52 can be fixed at least at several desired heights. Preferably the interior support members 58 include no pin connectors 28 and no pin receivers 30. If desired, interior support members 58 can include such pin connectors 28 and pin receivers 30 such that the telescoping interior support members 58 can be fixed at a desired height.

Gate 14 includes a right end upright support member 60, a right end upper cross piece 62, a right end lower cross piece 64, and a set of four upright interior support members 66. The right end upright support member 60 includes an upper section and a lower section that telescope, with the lower section sliding into the upper section. Each of the four upright interior support members 66 includes an upper section and a lower section that telescope, with the lower section sliding into the upper section. The right end upright support member 60 is engaged to the upper cross piece 62 and to the lower cross piece 64. Each of the interior support members 66 is engaged to the upper cross piece 62 and the lower cross piece 64. Right end upright support member 60, right end upper cross piece 62, right end lower cross piece 64, and the set of four upright interior support members 66 make up a right end unit. The lower section of right end upright support member 60 includes pin receivers 30 and the upper section of right end upright support member 60 includes a pin connector 28 such that the lower and upper sections of support member 60 can be fixed at least at several desired heights. Preferably the interior support members 66 include no pin connectors 28 and no pin receivers 30. If desired, interior support members 66 can include such pin connectors 28 and pin receivers 30 such that the telescoping interior support members 66 can be fixed at a desired height.

Lower cross pieces 56, 64 telescope with each other. Cross piece 64 slides into cross piece 56. Cross piece 56 includes a pin connector 28 that can engage one of a set of in receivers 30 of the cross piece 64.

Upper cross pieces 54, 62 telescope with each other. Cross piece 62 slides into cross piece 54. Cross piece 54 includes a pin connector 28 that can engage one of a set of pin receivers 30 of the cross piece 62.

By employing the telescoping arrangement of cross pieces 56, 64 and of cross pieces 54, 62, gate 14 is minimizable in width. By employing the telescoping arrangement of upright support members 52, 60, gate 14 is minimizable in height.

FIG. 1C shows the gate 14 at a height greater than the height shown in FIG. 1A. FIG. 1C shows that the pin receivers 30 or openings 30 are disposed in an upper end portion of the lower sections of upright support members 52, 60 and that the pin connector 28 or the opening for the pin connector is disposed in a lower end portion of the upper sections of upright support members 52, 60.

It should be noted that interior support members 58, 66 are removable such that gate 14 can include a wide range of adjustment in the width direction. Interior support members 58, 66 can be friction fit into openings formed in the top side of cross pieces 56, 64 and into openings formed in the underside of cross pieces 54, 62.

The left end unit of gate 14 is the swing side and includes a lower swing axis connection 68 and an upper swing axis connection 70. The right end unit of gate 14 includes the latch mechanism 51.

Figure 2:
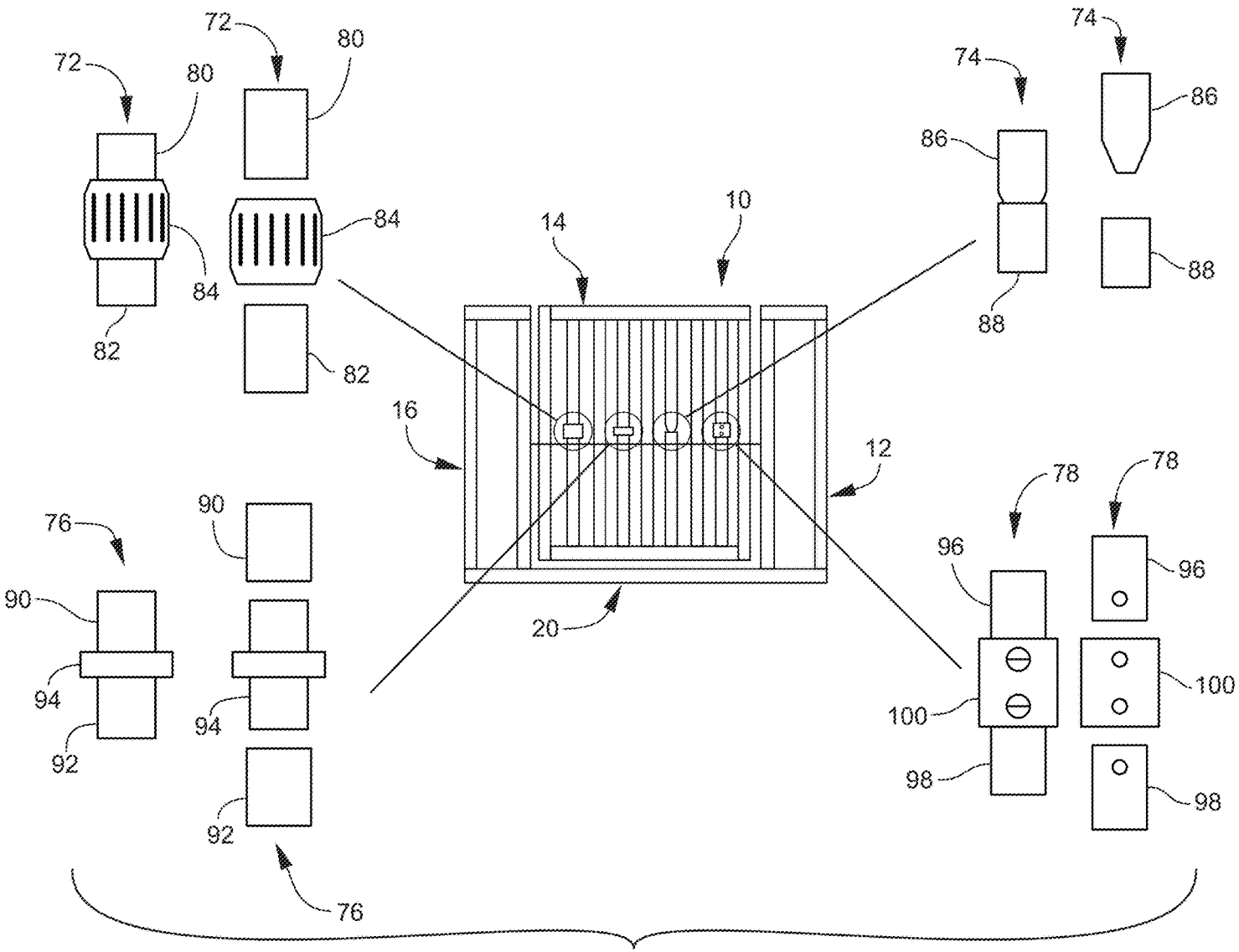
FIG. 2 shows an elevation view of the minimizable barrier of FIG. 1A and further shows four detail elevation views of four different types of couplers that may be used to fix the minimizable gate at a desired incremental operational height and that may be uncoupled to permit the minimizable gate to be reduced in height to a compact portable size.

FIG. 2 shows an elevation view of the frame 12 and gate 14 and four detail views of different couplers 72, 74, 76, 78 on interior support members of the gate 14. The couplers 72, 74, 76, 78 may also be employed on the vertical support members of the frame 12, such as when such vertical support members are cylindrical. The couplers 72, 74, 76, 78 may also be employed on the outer end vertical support members of the gate 14, such as when such vertical support members are cylindrical. The necked couplers 74 may include a male part and female part that engage each other over a greater length than is shown in FIG. 2. A top half section of the gate 14 and a bottom half section of the gate 14 may be disassembled and then assembled employing the couplers 72, 74, 76, 78 on the interior support members and the pin 28 and hole 30 arrangement of FIGS. 1A, 1B, and 1C on the end support members of the gate 14. The coupler 72 may be a twist lock coupler that when turned diametrically pinches the ends of the vertical support members 80, 82 of the gate 14 or another upright tubular support member of the barrier 10. The couplers 74, 76 may be friction fit couplers. The coupler 78 may employ pin fasteners such as screws.

FIG. 2 shows a diagrammatic view of the barrier 10 of FIGS. 1A, 1B, 1C and illustrates that, after being telescoped out, the fixing at a certain height of the upper and lower half sections of any of the upright support members of the barrier 10 of FIG. 2, including any of the end support members 52, 60 of gate 14, any of the interior support members 58, 66 of gate 14, any of the outer end upright support members of the frame 12, and any of the inner end upright support members of the frame 12, may be accomplished through the use of four different coupler embodiments 72, 74, 76, 78.

In FIG. 2, reference numbers 80, 82 represent the upper section and lower section, respectively, of any one of the end gate tubular support members 52, 60 when such are cylindrical or of any of the interior gate tubular support members 58, 66. Reference number 84 indicates a coupler that can have an interior mechanism with an eccentric or non-circular or elliptical inside diameter that can tighten to a fixed position with each of the upper and lower tubular sections 80, 82 that, may, for example, have oval or elliptical outside diameters. As to the types of locks for telescoping tubes or rods, the following U.S. patent references are hereby incorporated by reference in their entireties: 1) the Pinto et al. U.S. Pat. No. 4,154,545 issued May 15, 1979 and entitled Externally Mounted Multiple Cam Action Lock For Telescoping Tubes, 2) the Donohue U.S. Patent Application Publication No. US 2012/0155950 A1 published Jun. 21, 2012 and entitled Method And System Of An Extension Pole, 3) the Bertrand et al. U.S. Patent Application Publication No. US 2016/0017906 A1 published Jan. 21, 2016 and entitled Locking Telescoping Rod, 4) the Choffin U.S. Pat. No. 4,508,467 issued Apr. 2, 1985 and entitled Telescopically extendable Pole, 5) the Greenwood U.S. Pat. No. 3,667,788 issued Jun. 6, 1972 and entitled Cam Lock Device For Telescoping Tubing, 6) the Tseng U.S. Pat. No. 6,302,614 issued Oct. 16, 2001 and entitled Quick Coupling Arrangement For Telescopic Shaft, and 7) the Hanley U.S. Pat. No. 9,388,837 B1 issued Jul. 12, 2016 and entitled Telescoping Tube Assembly Having Twist Lock.

In FIG. 2, in coupler arrangement 74, reference numbers 86, 88 represent the upper section and lower section, respectively, of any one of the end gate tubular support members 52, 60 when such are cylindrical or of any of the interior gate tubular support members 58, 66. In coupler arrangement 74, the end frame support members 52, 60 and the interior support members 58, 66 may or may not be telescoping. If not telescoping, gate 14 is made of four units where upper cross member 54 and the upper support member sections of the end frame support member 52 and interior support members 58 make up a first unit, where upper cross member 62 and the upper support member sections of the end frame support member 60 and interior support members 66 make up a second unit, where lower cross member 56 and the lower support member sections of the end frame support member 52 and interior support members 58 make up a third unit, and where lower cross member 64 and the lower support member sections of end frame support member 60 and interior support members 66 make up a fourth unit. In this non-telescoping case, the upper support member section 86 is necked or tapered such that the necked or tapered portion rides on the upper annular end of the lower member section 88 for support. In a telescoping case, where member section 86, 88 telescope relative to each other, member 86 slides inside member 88 and, when slid out of member 88, an interior biased split annular member automatically is drawn to effectively form a closed annular member of a smaller diameter so as to provide support for the necked member section 86 and so as to prevent the necked member section 86 from telescoping back into member 88.

In FIG. 2, in coupler arrangement 76, reference numbers 90, 92 represent the upper section and lower section, respectively, of any one of the end gate tubular support members 52, 60 when such are cylindrical, or of any of the interior gate tubular support members 58, 66. Reference number 94 indicates a coupler 94 having an upper friction fit cylindrical or tubular portion, a lower friction fit cylindrical or tubular portion, and a disk shaped portion therebetween. The disk shaped portion has an outer circumference greater than the outside diameter of the upper and lower support member sections 90 92. Thus, after shipping and after lower member section 92 has been slid out of upper member section 94, coupler 94 is inserted between the free ends of the sections 90, 92 and then into the free ends of the sections 90, 92, whereupon the section 90, 92 are drawn together for a friction fit and to abut against the disk shaped portion of coupler 94.

In FIG. 2, in coupler arrangement 78, reference numbers 96, 98 represent the upper section and lower section, respectively, of any one of the end gate tubular support members 52, 60 when such are cylindrical, or of any of the interior gate tubular support members 58, 66. Reference number 100 indicates a U-shaped bracket that partially wraps about each of the upper section and lower sections 96, 98 to engage the member sections 96, 98 after shipping, and after lower member section 98 has been slid out of the female member section 96. The member sections 96, 98 have threaded pin receiver openings for being aligned with pin receiver openings in the U-shaped coupler 100, which pin receiver openings engage a pin connector or screw.

It should be noted that, for each of the coupler embodiments 72, 74, 76, 78, gate 14 may be a four unit gate as described above with respect to coupler arrangement 74.

Figure 3A:
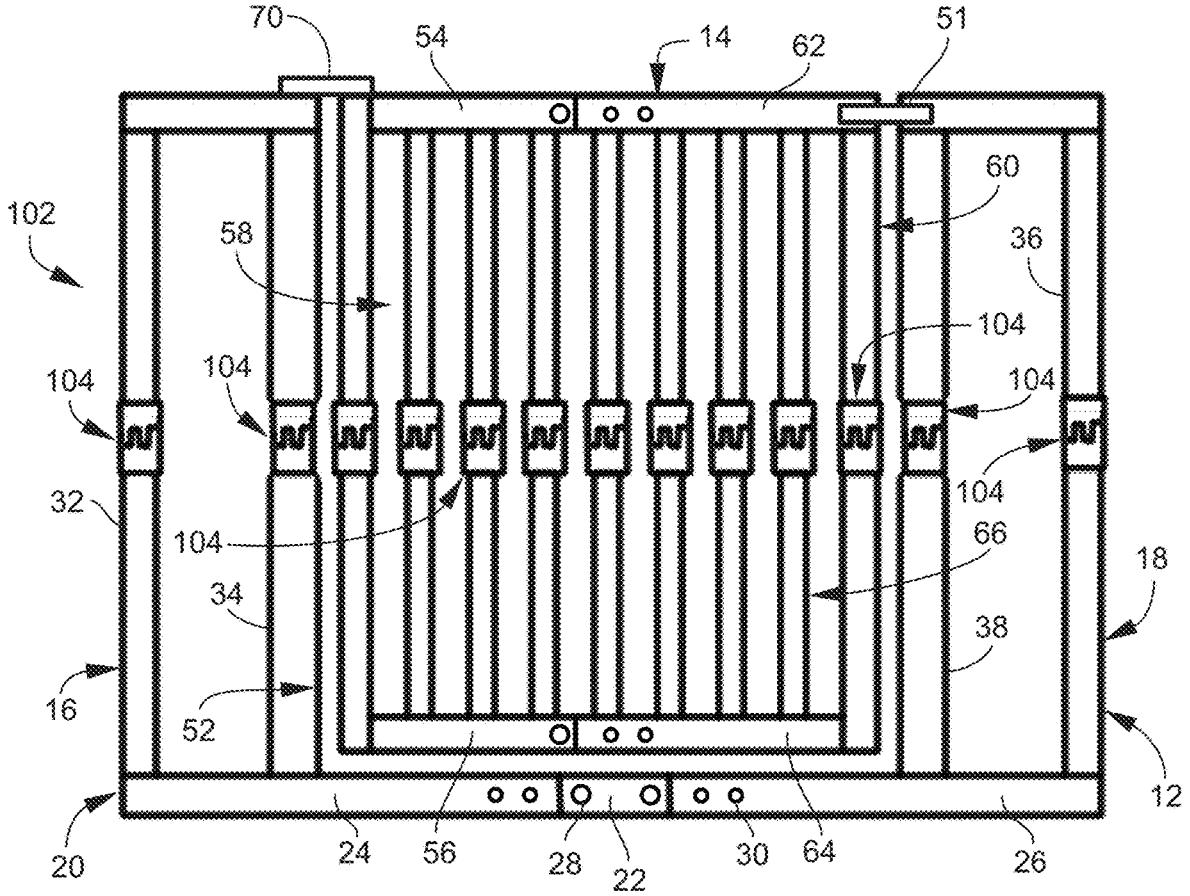
FIG. 3A is a front elevation view of a second embodiment of a minimizable barrier, where the minimizable barrier includes a minimizable gate and a minimizable frame, and where the minimizable barrier includes hinges intermediate upper and lower support members of the minimizable gate and frame.
Figure 3B:
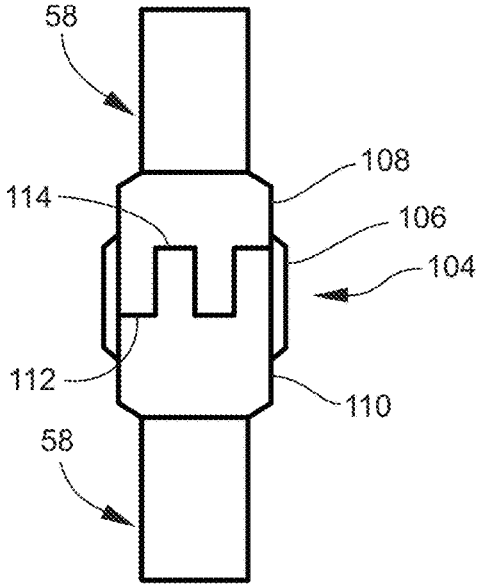
FIG. 3B is a front view of a hinge for the barrier of FIG. 3A.
Figure 3C:
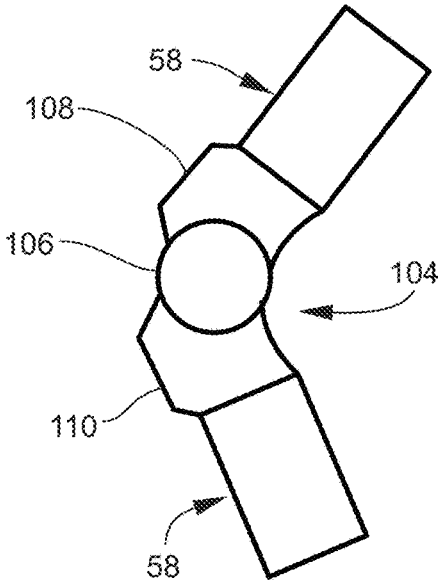
FIG. 3C is a side view of the coupler of FIG. 3B showing how the hinge and the support members of the frame and gate fold to a minimized size.

FIG. 3A shows an elevation view of the gate 14 of FIG. 1A with different couplers. FIG. 3B shows a front view of a hinge 104. FIG. 3C shows a side view of the hinge 104 of FIG. 1B. The gate 14 of FIG. 3A folds along a horizontal line to fold a top half section down upon a bottom half section. The gate 14 may also be reduced in size by employing telescoping or male/female arrangements such as shown in FIGS. 1A, 1B, and 1C. The cross piece of FIG. 3A may be disassembled to separate the first and second end frames 16, 18 from each other.

FIG. 3A shows a barrier 102. Barrier 102 is identical to barrier 10 except that barrier 102 includes hinges 104 on the upright support members 32, 34, 36, 38, 58, and 66 instead of the pin 28 and pin receiver 30 arrangement of barrier 10, except that gate 14 includes seven upright support members instead of the eight upright support members of barrier 10, except that the threshold telescoping cross pieces 22, 24, 26 may vary in length, and except that upright support members 32, 34, 36, 38 may be rectangular in section in barrier 10 and cylindrical, elliptical or oval in barrier 102. Hinge 104 includes a central pivot pin 106, an upper body 108 that engages the upper member section of upright support member 58 or of any other of the upright support members 32, 34, 36, 38, 52, 60, 66, and a lower body 110 that engages the lower member section of upright support member 58 or of any other of the upright support members 32, 34, 36, 38, 52, 60, 66. Each of the upper and lower bodies 108, 110 include annular tooth portions 112, 114, respectively, that engage the central pivot pin 106 and that mesh with the other annular tooth portion 112, 114.

Barrier 102 is minimizable in height by operation of the hinges 104. Gate 14 of barrier 102 is minimizable in height by operation of the hinges 104. Frame 12 of barrier 102 is minimizable in height by operation of the hinges 104.

Barrier 102 is minimizable in length by operation of the pin 28 and pin receiver 30 arrangement. Gate 14 of barrier 102 is minimizable in length by operation of the pin 28 and pin receiver 30 arrangement, by the telescoping of cross piece 54 with cross piece 62, and by the telescoping of cross piece 56 with cross piece 64. Frame 12 of barrier 102 is minimizable in length by the telescoping of threshold 20, i.e., the telescoping of cross pieces 22, 24, and 26. Barrier frame 102 can fold into a substantially planar form where the upper member sections of upright support members 32, 34, 36, 38, 52, 58, 60, and 66 fold against and in a substantially parallel relationship to the lower member sections of upright support members 32, 34, 36, 38, 52, 58, 60, and 66. At least one of the hinges 104 includes an internal locking mechanism that automatically moves into a locked position when the upper and lower member sections of the upright support members 32, 34, 36, 38, 52, 58, 60, and 66 swing into a straight line alignment.

Figure 4A:
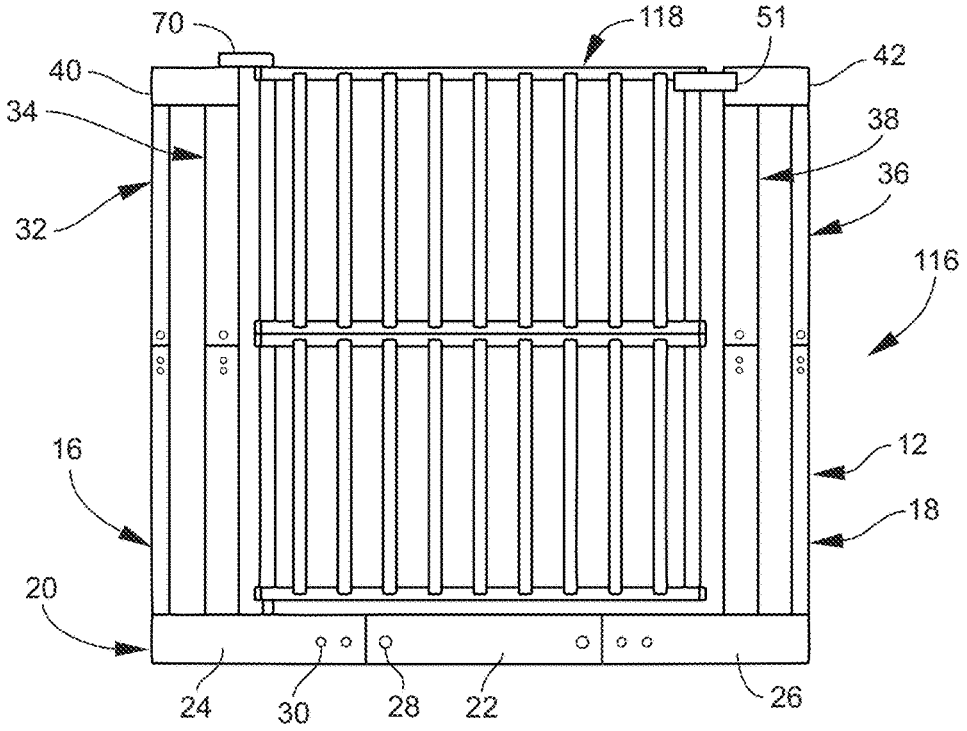
FIG. 4A is a front elevation of a third embodiment of a minimizable barrier, where the frame may be minimized according to any of the embodiments herein, and where the gate is minimized by the hinged horizontal intermediate member of FIG. 4B and/or the assembly gate of FIG. 4C that may be employed with or without the hinged horizontal intermediate member of FIG. 4B.
Figure 4B:
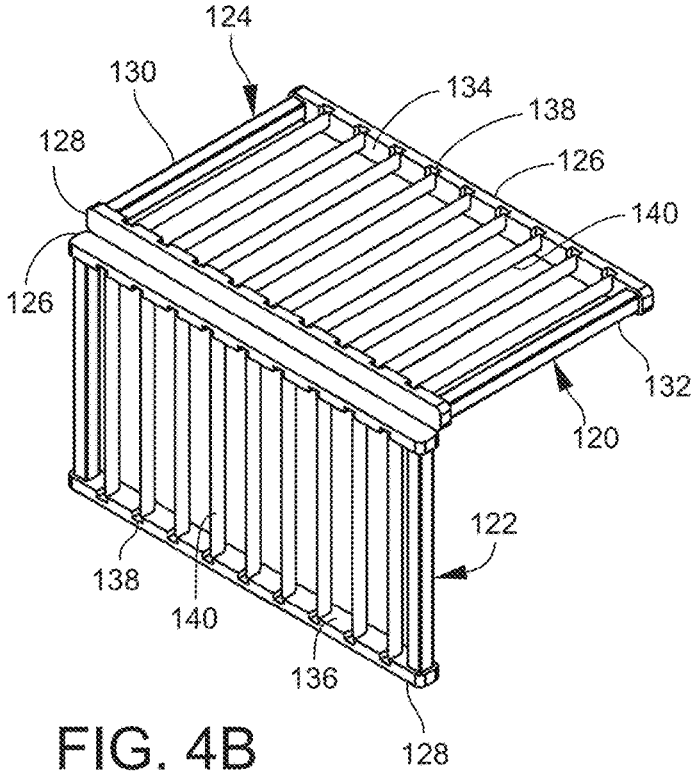
FIG. 4B is a perspective view of one of the embodiments of the minimizable gate of FIG. 4A, where the gate includes a hinged horizontal intermediate member having upper and lower support members permanently fixed or removably fixed from the hinged horizontal intermediate member.
Figure 4C:
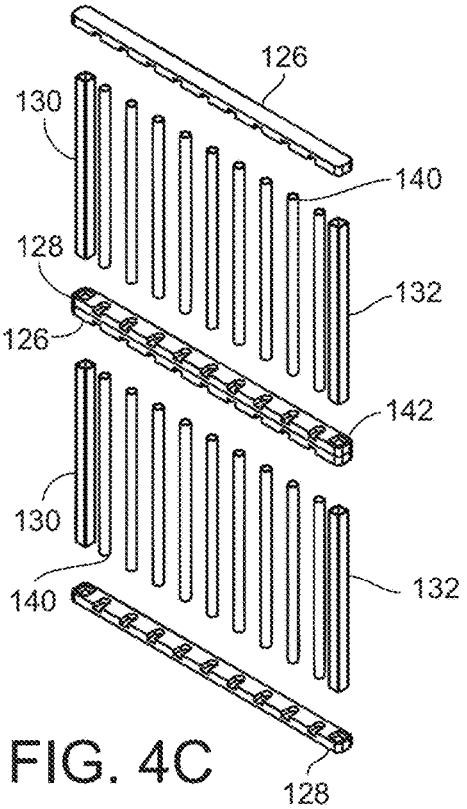
FIG. 4C is a perspective view of one of the embodiments of the minimizable gate of FIG. 4A, where the gate includes upper and lower support members removably fixed to a horizontal intermediate member that may or may not include upper and lower horizontal intermediate member portions hingedly engaged to each other.

FIG. 4A shows an elevation view of frame 12 and a gate 118. FIG. 4B shows a perspective view of the gate 12 of FIG. 4A folding to be reduced in size. FIG. 4C shows a broken down view of the gate 118. The gate 118 may be shipped in the state shown in FIG. 4B but when completely folded, or the gate 118 may be shipped in the state shown in FIG. 4C. The end frames 16, 18 of FIG. 4A may also employ coupler hinges. The end frames 16, 18 of FIG. 4A may take the structure shown in FIG. 1A.

FIG. 4A shows a barrier 116. Barrier 116 includes minimizable frame 12 such that frame 12 includes left end frame portion 16 having upright support members 32, 34, right end frame portion 18 having upright support members 36, 38, and threshold 20 having telescoping cross piece members 22, 24, 26.

Barrier 116 includes the minimizable gate 118. Gate 118 includes an upper half section 120 that is identical to a lower half section 122. Each of the half sections 120, 122 includes a generally rectangular frame 124. Frame 124 includes an upper horizontal member 126, a lower horizontal member 128, a left end upright member 130, and a right end upright member 132. Upper horizontal member 126 includes a lower face 134. Lower horizontal member 128 includes an upper face 136. Each of the lower and upper faces 134 includes a set of slots 138 for receiving an end of an upright support member 140. The ends of upright support members 140 are friction fit into slots 138. Left end upright member 130 and right end upright member 132 are friction fit into rectangular openings 142 formed in the ends of lower and upper faces 134.

Gate 118 may include two embodiments. In a first embodiment shown in FIG. 4B, the lower horizontal member 128 of upper half section 120 is hingedly connected to the upper horizontal member 126 of the lower half section 122. The hinge employed may be a flexible living sheet like hinge engaged to rear side faces of lower horizontal member 128 of upper half section 120 and upper horizontal member 126 of lower half section 122. The flexible sheet like hinge may be formed of a flexible plastic, textile, or fabric. When folded or minimized, upper half section 120 and lower half section 122 abut each other and lie in parallel planes. In a second embodiment, shown in FIG. 4C, the lower horizontal member 128 of upper half section and the upper horizontal member 126 of lower half section may be hingedly engaged with such flexible living sheet like hinge or may be permanently engaged to each other where the lower face of lower horizontal member 128 of upper half section 120 lies upon and is engaged to the upper face of the upper horizontal member 126 of the lower half section 122 such that gate 118 is shipped in the broken down state shown in FIG. 4C with the elements disassembled except for the lower horizontal member 128 of the upper half section 120 and the upper horizontal member 126 of the lower half section 122 that may be shipped as a living hinge or as a permanently connected one-piece element. Upright members 130, 132 are square in section. Upright members 140 are cylindrical in section or, if desired, may be oval, oblong, or elliptical in section.

Gate 118 is constructed by first friction fitting or snapping the left and right end upright support members 130, 132 to the upper and lower horizontal members 126, 128. Second, the cylindrical upright support members 140 are friction slid or snapped into upper and lower slots or seats 138.

As to the living hinge embodiment of FIG. 4B, such gate 118 may be shipped in the assembled but folded form.

Barrier 118 is thus minimizable in the height direction and in the length direction. Frame 12 is minimizable in the height direction by the telescoping upright support members 32, 34, 36, 38 and is further minimizable in the length direction by the telescoping threshold horizontal cross piece members 22, 24, 26.

The embodiment of the gate 118 as shown in FIG. 4B is minimizable in the height direction by the living hinge. Gate 118 can be further minimized in each of the height and length directions where the gate 118 is reducible to each of the elements being disassembled, as shown in FIG. 4C.

Figure 5B:
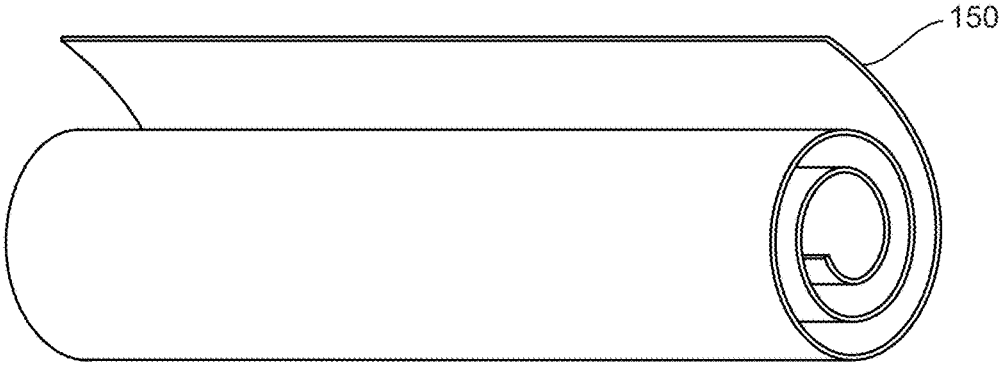
FIG. 5B shows the rolled mesh of FIG. 5A in a rolled up state.

FIG. 5A shows an elevation view of a frame 144 and a rolled out gate 146. FIG. 5B shows a perspective view of the gate 146 having been rolled up. The gate 146 may have a rectangular frame 148 that supports the mesh 150. This frame 148 may be reduced in at least one of a height and length dimension by any of the structures shown herein, such as by telescoping or by employing couplers or by any other concept. The frame 144, including the first and second end frames 34, 38 and cross piece 20, may be reduced in height and length by, for instance, the structure shown in FIG. 1A. For purposes of clarity, the mesh is not shown in FIG. 5B.

FIG. 5A shows a barrier 142. Barrier 142 may have the minimizable barrier frame 144 that includes left upright support member 34, right upright support member 38, and threshold cross piece 20. Each of the left and right upright support members 34, 38 have upper and lower telescoping member sections such that barrier frame 144 is minimizable in the height direction. Threshold cross piece 20 has telescoping member sections 22, 24, 26 such that barrier frame 144 is minimizable in the width direction.

Barrier 142 includes a minimizable gate 146 having a gate frame 148 and a gate interior body 150. Gate frame 148 includes upper telescoping cross pieces 54, 62, lower telescoping cross pieces 56, 64, a left upright support member 52 having upper and lower telescoping member sections, and a right upright support member 60 having upper and lower telescoping member sections. Gate interior body 150 is a mesh or mesh rail that includes a rolled out form or minimizable form as shown in FIG. 5A and a rolled up or minimized form as shown in FIG. 5B. Gate interior body 150 may be engaged to gate frame 148 in a number of ways such as with a number of hooks set into the interior periphery of the gate frame 148 so as to engage the upper and lower edges of the gate body 150 and so as to further engage the right and left edges of the gate body 150. The mesh of gate body 150 is slightly stretchable or resilient such that the body 150 can be stretched width wise to engage the hooks running vertically and such that the body 150 can then be stretched height wise to engage the hooks running horizontally. The hooks may be open conventional hooks or may be closed hooks or carabiners.

Frame 144 is a pressure frame such that one or both of the upright members 34, 38 are fabricated to be oblique relative to threshold 20 and such that hand wheel mechanisms 44 are employed to pressurize the barrier frame 144 relative to two vertical surfaces such as door jambs.

Figure 6A:
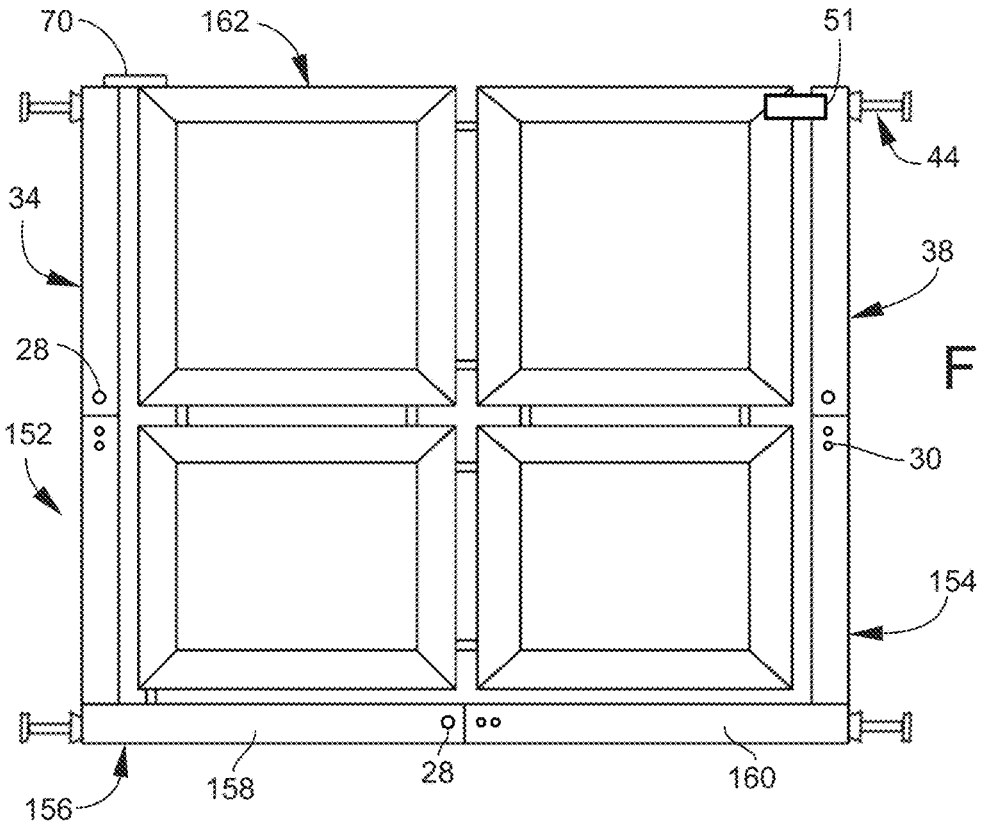
FIG. 6A is a front elevation of a fifth embodiment of a minimizable barrier, where the frame may be minimized according to any of the embodiments herein, and where the gate is minimized by the inclusion of a set of four modular panels interconnected by pegs.
Figure 6B:
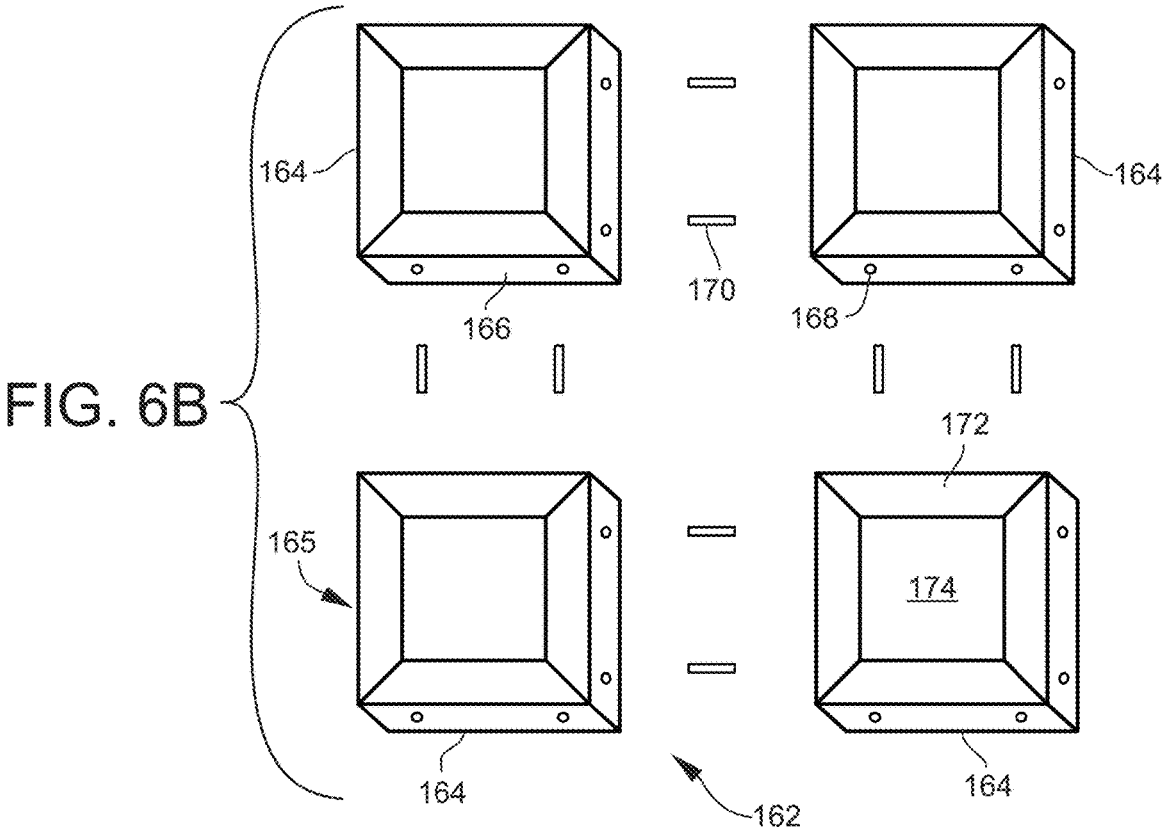
FIG. 6B is a front perspective exploded view of the modular panels and pegs of FIG. 6A

FIG. 6A shows an elevation view of a frame 154 and a gate 162. FIG. 6B shows a perspective view of the gate 162 of FIG. 6A broken down into modular panels 164. The frame 154, including the first and second end frames 34, 38 and cross piece 156 may be reduced in height and length by, for instance, the structure shown in FIG. 1A. The door is shipped and stored in the state shown in FIG. 6B.

FIG. 6A shows a barrier 152. Barrier 152 includes the frame 154 having left end upright frame member 34, right end upright frame member 38, and the threshold cross piece 156. Left end upright frame member 34 includes upper and lower telescoping sections. Right end upright frame member 38 includes upper and lower telescoping sections. Threshold cross piece 156 is identical to threshold cross piece 20 except that threshold cross piece 156 includes two telescoping members 158, 160 instead of the three telescoping members 22, 24, 26 of threshold cross piece 20. Frame 154 is thus minimizable in height and in width.

Barrier 152 includes modular panel gate 162 that includes the set of four modular panels 164. Each of the panels 164 includes a square frame 165 having four outer peripheral faces 166. Each of the peripheral faces 166 includes a pair of peg openings or peg receivers 168 for the reception of a peg 170. Peg 170 may snap fit or friction fit into peg receiver 168. Eight pegs 170 are preferred for gate 162 having four modular panels 164 such that each of the panels 164 is engaged directly to two other panels 164. On each of the sides of panel 164, frame 165 includes four oblique quadrilateral faces 172 terminating at a square piece 174. The thickness of frame 165 is greater than the thickness of square piece 174. Piece 174 may be see-through or opaque. Gate 162, once assembled, is minimizable or reducible in both height and width by removing the pegs 170 from the peg openings 168. Each of the sides of the modular panel 164 has a length about equal to or slightly less than the length of each of the telescoping sections of left and right end frame members 34, 38. Each of the sides of the modular panel 164 has a length about equal to or slightly less than the length of each of the telescoping sections 158, 160 of the threshold cross piece 156. When assembled, the four modular panels 164 define a plane and are co-planar with the barrier frame 154.

Frame 154 is preferably a pressure frame. That is, one of more of left end upright support member 34 and right end upright support member 38 is fabricated at an oblique angle to threshold cross piece 156 such that hand wheel mechanisms 44 when operated push in one or more of the support members 34, 38 until the opposing portions of latch 51 become engaged and/or until one or more of the support members 34, 38 become disposed at a right angle with threshold cross piece 156.

Figure 7A:
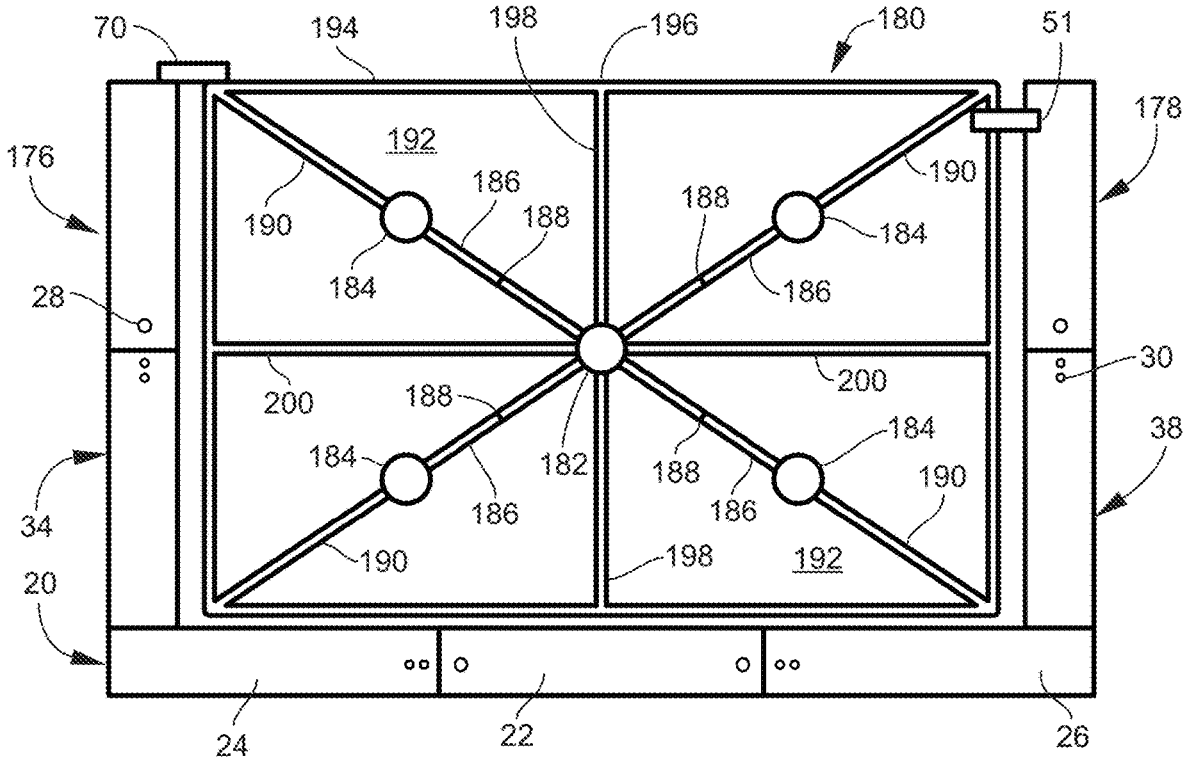
FIG. 7A is a front elevation of a sixth embodiment of a minimizable barrier, where the frame may be minimized according to any of the embodiments herein, and where the gate is minimized by the inclusion of an integral set of expandable umbrella portions.
Figure 7B:
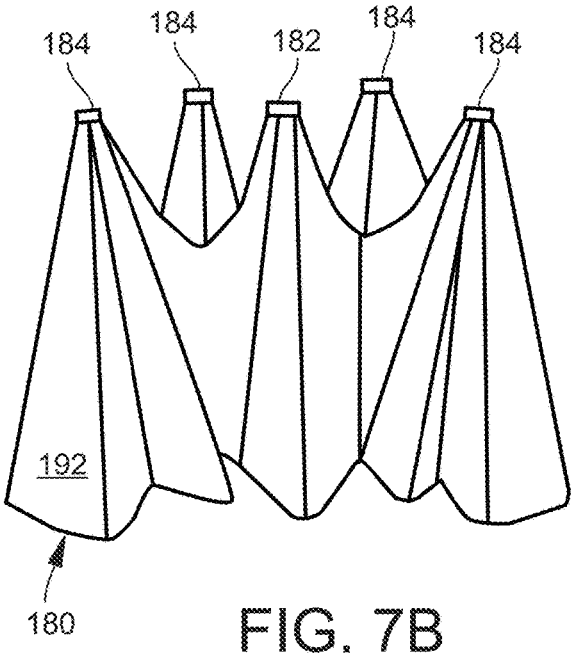
FIG. 7B is a side perspective view of the integral set of expandable umbrella portions of FIG. 7A.

FIG. 7A shows an elevation view of a frame 178 and expanded gate 180. FIG. 7B shows a perspective view of the gate 180 of FIG. 7A in a collapsed state. The frame 178, including the first and second end frames 34, 38 and cross piece 20, may be reduced in height and length by, for instance, the structure shown in FIG. 1A. The door is shipped and stored in the state shown in FIG. 7B, albeit having a greater folded state than shown in FIG. 7B, such as a state where hubs 182, 184 are adjacent to each other.

FIG. 7A shows barrier 176. Barrier 176 includes the minimizable U-shaped open top frame 178. Frame 178 includes left end upright support member 34, right end upright support member 38, and threshold cross piece 20. Left end upright support member 34 includes upper and lower telescoping member sections. Right end upright support member 38 includes upper and lower telescoping member sections. Threshold cross piece 20 includes telescoping sections 22, 24, and 26. Thus frame 178 is minimizable or reducible in each of the height and length directions.

Barrier 176 includes the minimizable gate 180. Gate 180 includes a main hub 182. Operation of main hub 182, such as by rotation of a portion of main hub 182, or a drawing out of a main portion of main hub 182, draws in lines that engage mechanisms inside of secondary hubs 184 that unlock the secondary hubs 184. Operation of main hub 182 controls the proximal portions of main tubes 186. The proximal portions of main tubes 186 run from main hub 182 to a joint 188. A distal end of main tubes 186 runs from joint 188 to secondary hub 184. Each of the main tubes 186, when folded, forms a V-shape. The joint 188 permits such a fold. Joint 188 locks when the lines operated by main hub 182 trip the mechanism in secondary hubs 184, which mechanism splays out, umbrella style, the distal portions of tubes 186 and a secondary tube 190. Gate 180 includes four secondary tubes 190 that run from each of the secondary hubs 184 to each of the corners of the gate 180. Once the proximal and distal ends of the main tubes 186 and the secondary tubes 190 are fixed in a straight line, a living or flexible fabric or fabric like piece or body 192 is folded out to a rectangular form to form a gate 180 that is relatively rigid. Gate 180 includes a rectangular frame formed of eight tubing portions 194, where joints 196 are disposed between each junction of the tubing portions. Gate 180 further includes two vertical tubing portions 198 and two horizontal tubing portions 200 that are controlled by the main hub 182 and that become fixed in a planar relationship with each other when main hub 182 draws in the line that controls operation of secondary hubs 184. Thus, gate 180 is minimizable in both height and width from the form shown in FIG. 7A to the form shown in FIG. 7B. It should be further noted that the form shown in FIG. 7B is further minimizable in width by drawing in secondary hubs 184 to the main hub 182 such that main hub 182 is adjacent to secondary hubs 184.

Figure 8A:
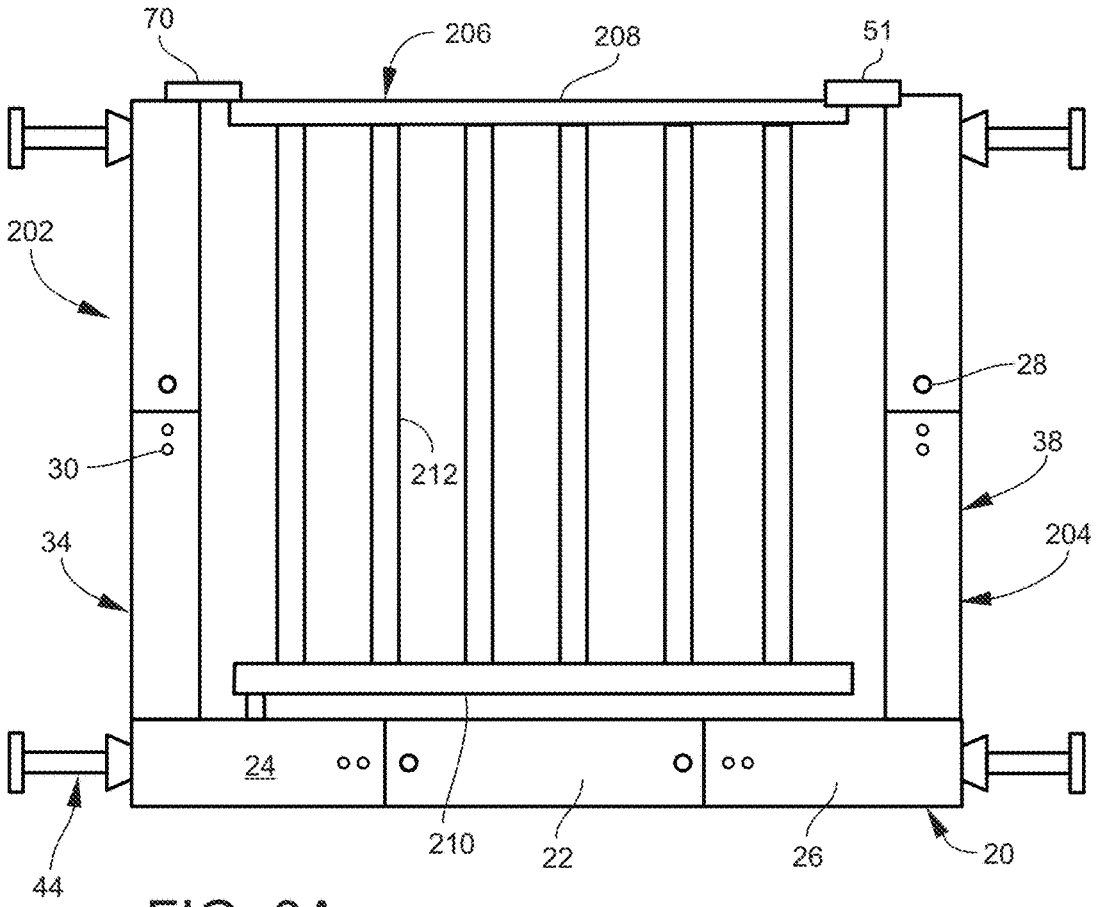
FIG. 8A is a front elevation of a seventh embodiment of a minimizable barrier, where the frame may be minimized according to any of the embodiments herein, and where the gate is minimized by the inclusion of a set of hinged tubes that collapse in a plane with each other.
Figure 8B:
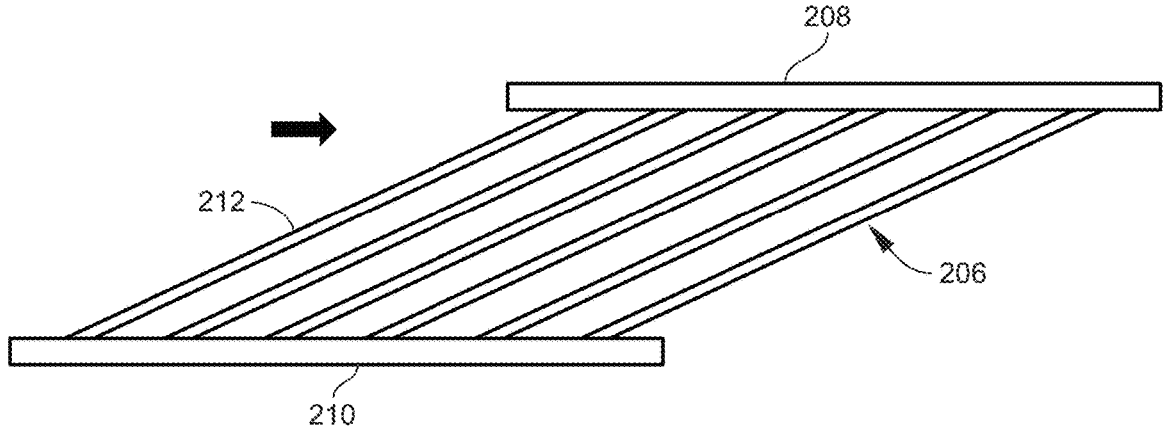
FIG. 8B is a front elevation view of the set of hinged tubes of FIG. 8A in a state of being collapsed.

FIG. 8A shows an elevation view of a gate 206 and frame 204. FIG. 8B shows the gate 206 of FIG. 8A in the process of being collapsed. The frame 204, including the first and second end frames 34, 38 and cross piece 20 of FIG. 8A, may be reduced in height and length by, for instance, the structure shown in FIG. 1A. The door is shipped and stored after being further folded from the state shown in FIG. 8B.

FIG. 8A shows barrier 202. Barrier 202 includes the minimizable U-shaped open top frame 204. Frame 204 includes left end upright support member 34, right end upright support member 38, and threshold cross piece 20. Left end upright support member 34 includes upper and lower telescoping member sections. Right end upright support member 38 includes upper and lower telescoping member sections. Threshold cross piece 20 includes telescoping sections 22, 24, and 26. Thus frame 204 is minimizable or reducible in each of the height and length directions.

Barrier 202 includes gate 206. Gate 206 includes an upper horizontal support member 208, a lower horizontal support member 210, and a set of upright support members 212. At least one of the upper ends of the upright support members 212 includes a joint with the upper horizontal support member 208 that is lockable and unlockable. At least one of the lower ends of the upright support members 212 includes a joint with the lower horizontal support member 210 that is lockable and unlockable. If desired, each of the upright support members 212 can have an upper joint with the upper horizontal support member 208 that is lockable and unlockable. If desired, each of the upright support members 212 can have a lower joint with the lower horizontal support member 210 that is lockable and unlockable. Since the junctions of upright support members 212 with the upper and lower horizontal support members 208, 210 articulate, gate 206 is minimizable in height. Gate 206 is minimizable in height until the upright support members 212 are adjacent to and abut each other. Gate 206 is reducible in height beyond the state shown in FIG. 8B.

Figure 9A:
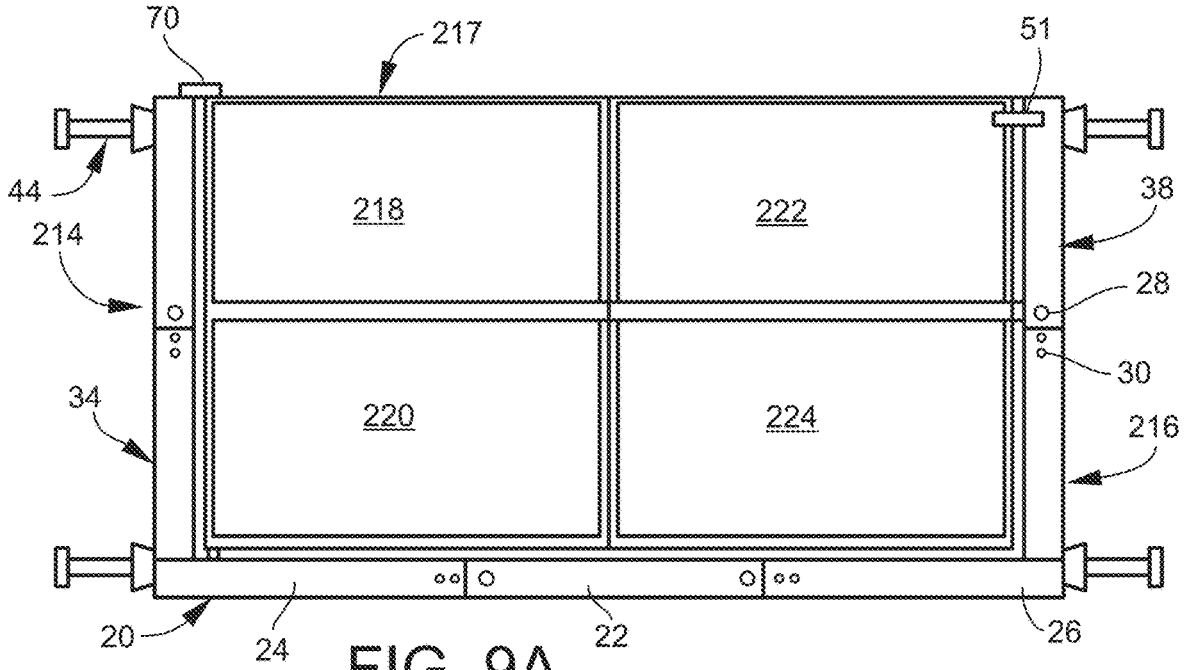
FIG. 9A is a front elevation of an eighth embodiment of a minimizable barrier, where the frame may be minimized according to any of the embodiments herein, and where the gate is minimized by the inclusion of a set of two panels that slide vertically relative to each other (FIG. 9B) to create a full door or that slide horizontally relative to each other (FIG. 9C) to create a full door.
Figure 9B:
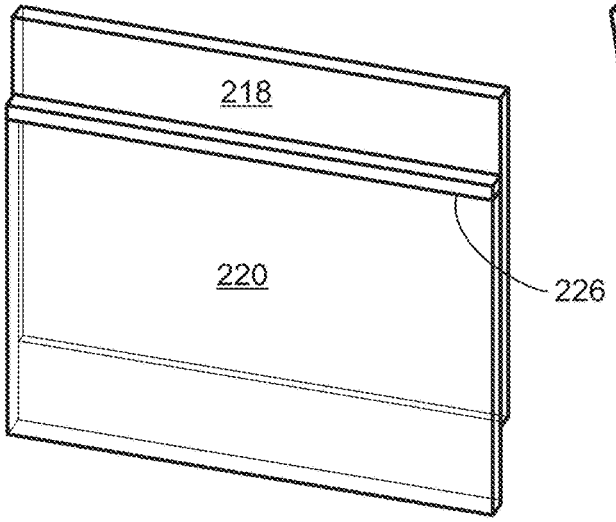
FIG. 9B is a perspective view of the embodiment where the two sliding panels of FIG. 9A slide vertically relative to each other.
Figure 9C:
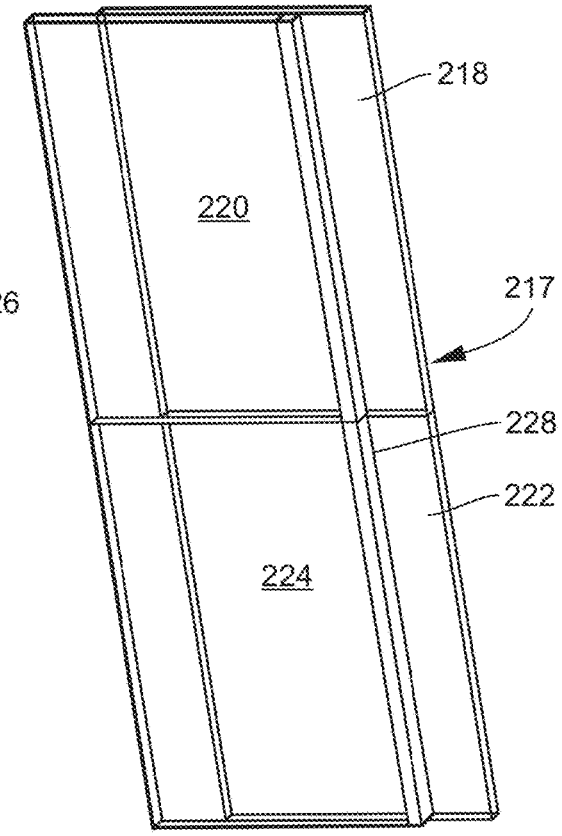
FIG. 9C is a perspective view of the embodiment where the two sliding panels of FIG. 9A slide horizontally relative to each other.

FIG. 9A shows an elevation view of a frame 216 and gate 217. FIG. 9B shows a perspective view of the panels 218, 220 of the gate 217 of FIG. 9A in the process of sliding vertically to take up less space. FIG. 9C shows a perspective view of the panels 218, 220, 222, 224 of the gate 217 of FIG. 9A in the process of sliding horizontally to take up less space. The frame 216, including the first and second end frames 34, 38 and cross piece 20 of FIG. 9A, may be reduced in height and length by, for instance, the structure shown in FIG. 1A. The fate 217 is shipped and stored after being further slid to a further compact form than the state shown in FIGS. 9B and 9C.

FIG. 9A shows a barrier 214. Barrier 214 includes the minimizable U-shaped open top frame 216. Frame 214 includes left end upright support member 34, right end upright support member 38, and threshold cross piece 20. Left end upright support member 34 includes upper and lower telescoping member sections. Right end upright support member 38 includes upper and lower telescoping member sections. Threshold cross piece 20 includes telescoping sections 22, 24, and 26. Thus frame 214 is minimizable or reducible in each of the height and length directions.

Barrier 214 includes the gate 217. Gate 217 includes four panels 218, 220, 222, and 224. Panel 218 slides relative to panel 220. Panels 218, 220 are engaged to each other with tracks at their vertical edges. Panels 218, 220 are lockable in the fully slid out position shown in FIG. 9A and, in such position, panels 218, 220 are engaged to the barrier frame 216 so that the panels 218, 220 can swing. Panel 222 slides relative to panel 224. Panels 222, 224 are engaged to each other with tracks at their vertical edges. Panels 222, 224 are lockable in the fully slid out position shown in FIG. 9A and, in such position, panels 222, 224 are engaged to panels 218, 220 through an internal piece engaged with each of the horizontal tubing 226 of panel 220 and horizontal tubing 228 of panel 224. The inner ends of tubing 226, 228 are open and an elongate piece with a square section is engaged in the open inner ends to fix the two sliding units to each other, where one sliding unit is the combination of panels 218, 220 and where the other sliding unit is the combination of panels 222, 224. If desired, there may be other interlocks, such as male/female interlocks, between the confronting vertical edges of panels 218, 222 and between the confronting vertical edges of panels 220, 224. In light of the above, gate 217 is minimizable in both height and width.

FIG. 9B shows the left pair of panels 218, 220 having been partially minimized or reduced in height after having been removed from the barrier frame 216. A full reduction in height is where the tubing 226 is adjacent to the top edge of panel 218. The right pair of panels 222, 224 may be slid to the position shown in FIG. 9B as well. Also, a full reduction in height for panels 222, 224 is where tubing 228 is adjacent top edge of panel 222.

FIG. 9C shows that gate 217 having panels 218, 220, 222, 224 may be turned ninety degrees. After being turned ninety degrees the gate 217 may be engaged to barrier frame 216 such that tubing 226, 228 runs vertically.

Figure 10A:
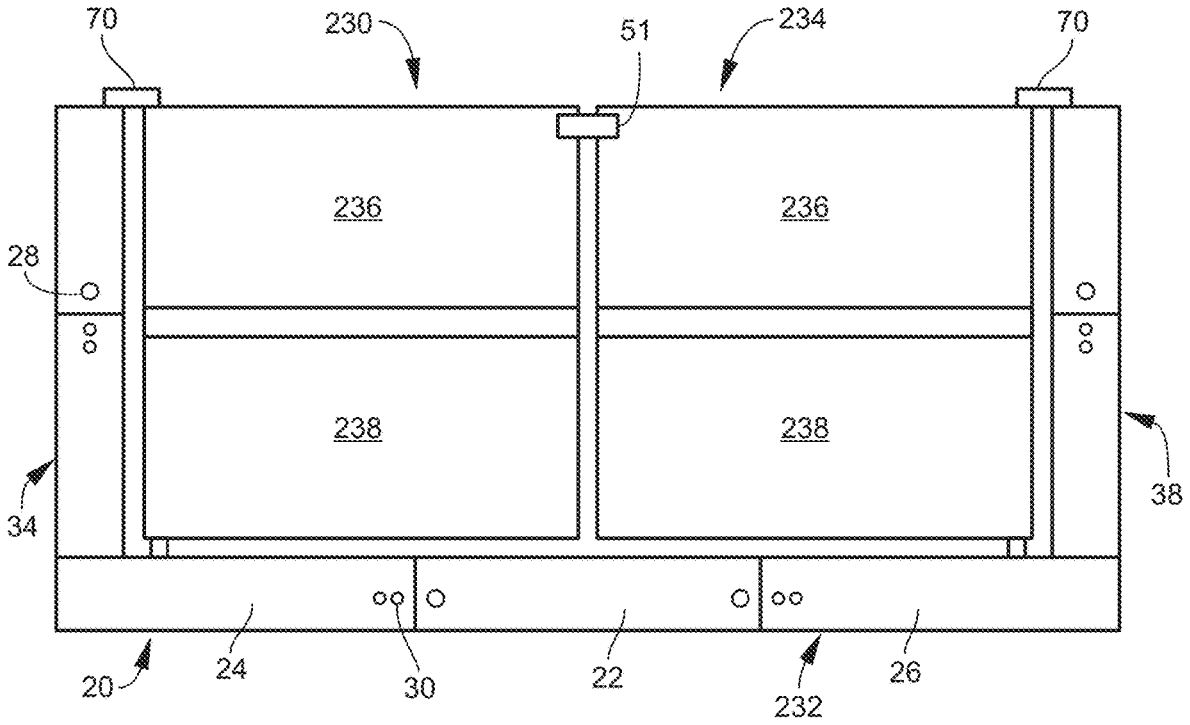
FIG. 10A is a front elevation of a ninth embodiment of a minimizable barrier, where the frame may be minimized according to any of the embodiments herein, and where the gate is minimized by the inclusion of two sets of two panels each, where each of the sets of panels slide vertically relative to each other (FIG. 10B), and where each of the sets of panels makes up one-half of a double hung saloon style door or gate.
Figure 10B:
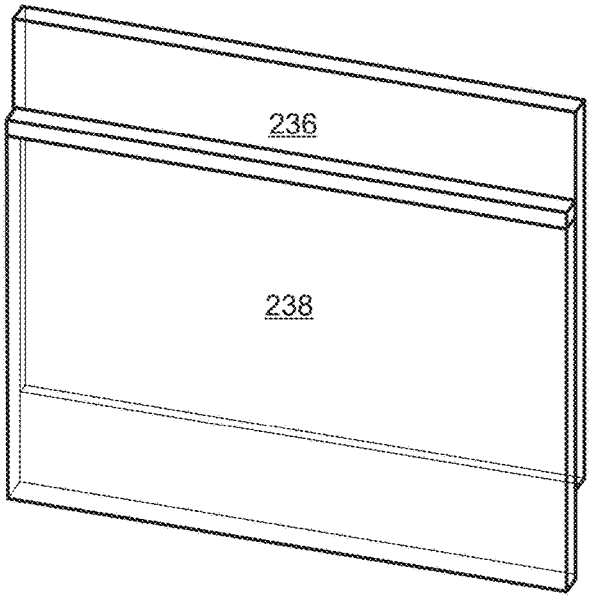
FIG. 10B is a front perspective view of one set of the two panels of FIG. 10A.

FIG. 10A shows an elevation view of a gate 234 and frame 232. FIG. 10B shows a perspective view of the panels 236, 238 of one side of the double hung saloon door or gate 234 in the process of sliding vertically to take up less space. The frame 232, including the first and second end frames 34, 38 and cross piece 20 of FIG. 10A, may be reduced in height and length by, for instance, the structure shown in FIG. 1A. The door or gate 234 is shipped and stored in the state shown in FIG. 10B where the right half two sections 236, 238 are placed on top of, or on the side of, the left half two sections 236, 238 so as to increase the width dimension but not the height or length dimension.

FIG. 10A shows barrier 230. Barrier 230 includes minimizable U-shaped open top frame 232. Frame 232 includes left end upright support member 34, right end upright support member 38, and threshold cross piece 20. Left end upright support member 34 includes upper and lower telescoping member sections. Right end upright support member 38 includes upper and lower telescoping member sections. Threshold cross piece 20 includes telescoping sections 22, 24, and 26. Thus frame 232 is minimizable or reducible in each of the height and length directions.

Barrier 230 includes gate 234. Gate 234 is a double hung saloon door. Gate 234 includes two sets of two panels 236, 238. Panel 236 slides relative to panel 238. Panels 236, 238 are engaged to each other with tracks at their vertical edges. Accordingly, gate 234 is minimizable in both height and width.

Panels 236, 238 are lockable in the fully slid out position shown in FIG. 10A and, in such position, each of the sets of panels 236, 238 are engaged to the barrier frame 232 so that each of the sets of panels 236, 238 can swing. One set of panels 236, 238 has a swing axis adjacent to left end upright support member 34. The other set of panels 236, 238 has a swing axis adjacent to right end upright support member 38. Each of the sets of panels 236, 238 is engagable to and disengageable from the U-shaped open top frame 232. The inner lower ends of each of the panels 238 may be removably latched to threshold member section 22.

Figure 11A:
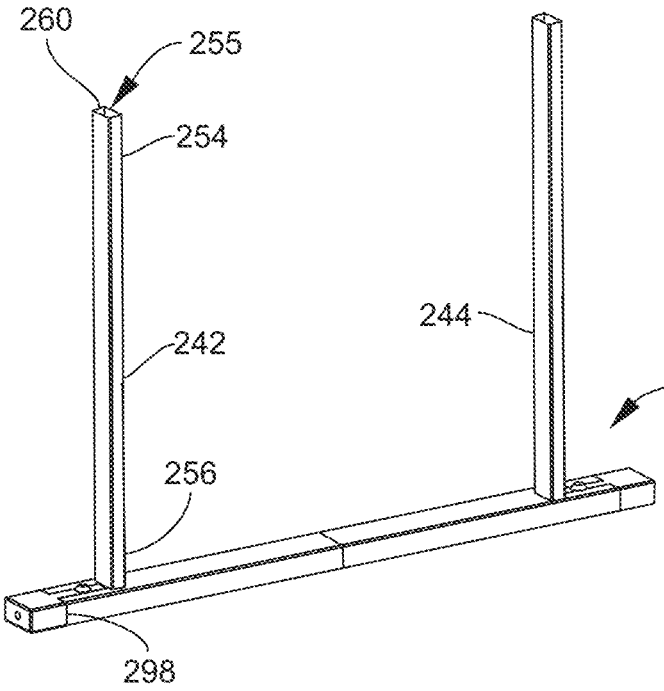
FIG. 11A is a front perspective view of a minimizable frame that may be used with any of the minimizable gates herein, where the minimizable frame includes a slot and end cap mechanism.
Figure 11B:
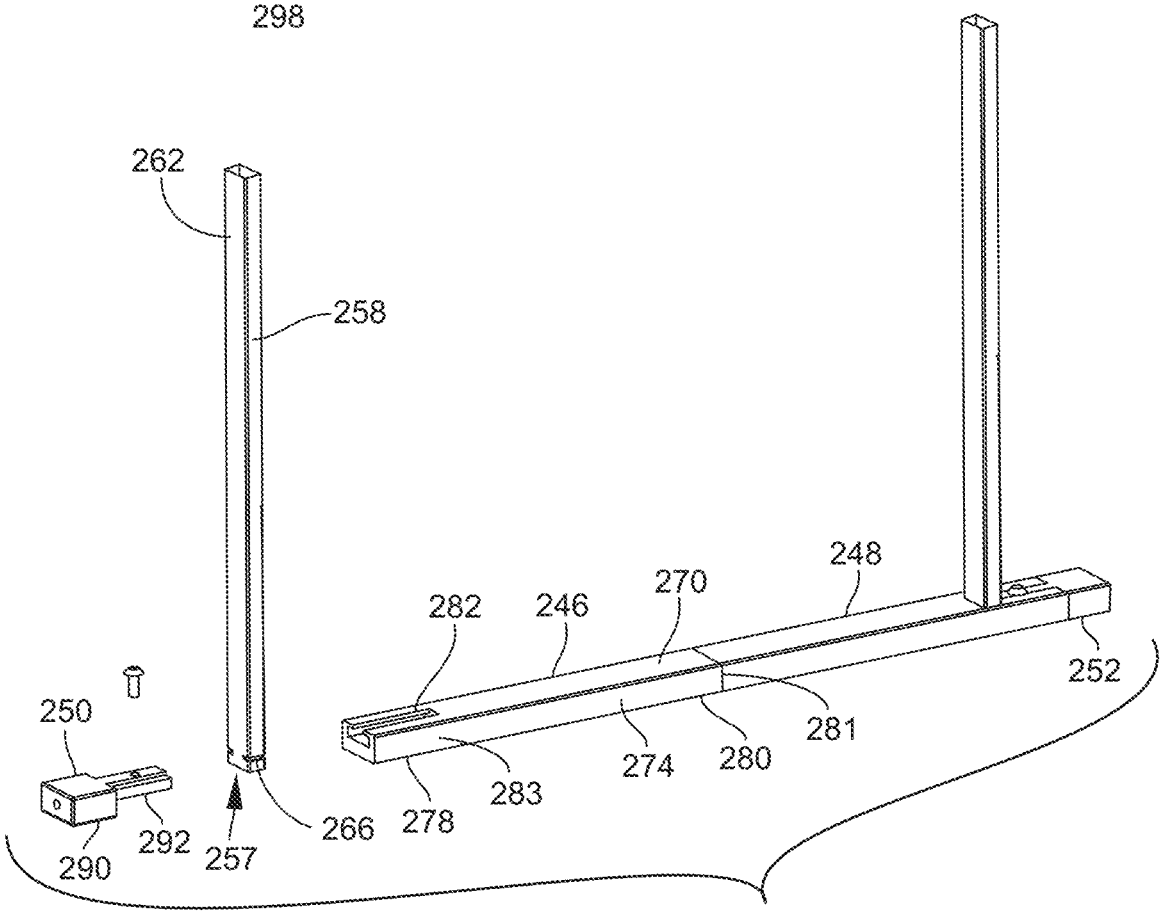
FIG. 11B is a front perspective, partially broken apart view of the minimizable frame of FIG. 11A.
Figure 12B:
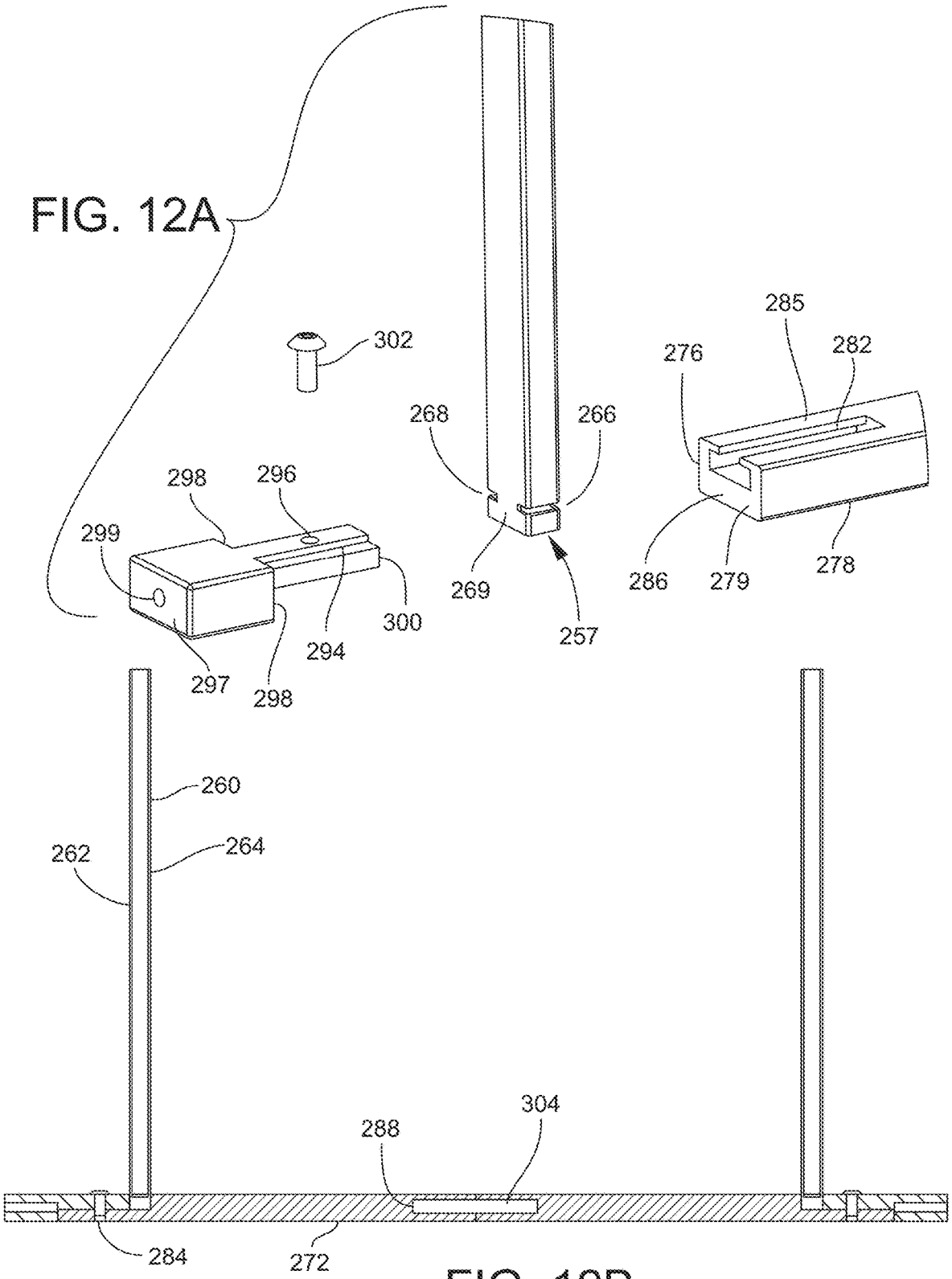
FIG. 12B is a partially section view of the minimizable gate of FIG. 11A.

FIG. 11A shows a perspective view of a frame 240 fully assembled. FIG. 11B shows a perspective view of the frame 240 of FIG. 11A in a perspective exploded view. FIG. 12A shows an exploded detail perspective view of a portion of the frame 240 of FIG. 11A. FIG. 12B shows a section view of the cross piece sections 246, 248 and upright support members 242, 244 of FIG. 11A. The first and second end frames 242, 244 and the cross piece made up of the cross piece sections 246, 248 and end caps 250, 252 may be shipped and stored in the state shown in FIG. 11B, where the cross piece sections 246, 248 may or may not be further separated at an intermediate or middle location and where the end caps 250, 252 may or may not be shipped and stored temporarily engaged with cross piece sections 246, 248.

FIG. 11A shows a barrier frame 240 that may be employed with any of the gates herein. Barrier frame 240 includes first and second upright members 242, 244 that are identical to each other, first and second horizontal threshold members 246, 248 that are identical to each other, and first and second end caps 250, 252 that are identical to each other such that only first upright member 242, first horizontal threshold member 246, and first end cap 250 are being described herein.

First upright member 242 is tubular and rectangular in section. First upright member 242 includes an upper end portion 254 and a lower end portion 256. Upper end portion 254 includes an open tubular end 255. Lower end portion 256 includes an open tubular end 257. First upright member 242 includes a front side 258, a rear side 260, an outer side 262, and an inner side 264. Front and rear sides 258, 260 oppose each other. Outer and inner sides 262, 264 oppose each other.

The lower end portion 256 of the first upright member 242 includes a front horizontal slot 266 cutting through the outer side 262, the front side 258, and the inner side 264. Slot 266 is spaced from the lower open tubular end 257.

The lower end portion 256 of the first upright member 242 further includes a rear horizontal slot 268 cutting through the outer side 262, the rear side 260, and the inner side 264. Slot 268 is spaced from the lower open tubular end 257 and is further spaced from slot 266. Slots 266, 268 define a plane. Slots 266, 268 effectively form a T-shape section 269 in the lower end portion 256.

First horizontal support member 246 may preferably be a solid piece of metal, plastic, wood, wood composite, or another substrate. First horizontal support member 246 is rectangular in section so as to have an upper side 270, a lower side 272, a front side 274, and a rear side 276. Upper and lower sides 270, 272 oppose each other. Front and rear sides 274, 276 oppose each other. First horizontal support member 246 includes an outer end portion 278 with an absolute outer end 279 and an inner end portion 280 with an absolute inner end 281.

Outer end portion 278 is effectively a tubular portion. The outer end portion 278 includes a T-shaped slot 282 that is open on the front side 274 and that is further open on the absolute outer end 279. The T-shaped slot 282 effectively forms a C-shape section 283 in the outer end portion 278 where the C-shape includes inwardly turned extensions 285.

Outer end portion 278 includes a vertical pin connector opening 284 extending from the T-shaped slot 282 to the lower side 272. Pin connector opening 284 is spaced from the absolute end 279 and is formed in the floor 286 of the C-shaped section 283. Pin connector opening 284 is equidistance from the front and rear sides 274, 276.

The inner end portion 280 includes an axially extending opening 288 that opens only at the absolute inner end 281. Opening 288 is rectangular when a section is taken at the inner end portion 280. Opening 288 is spaced from each of the upper, lower, front, and rear sides 270, 272, 274, 276 and includes four upper, lower, front, and rear faces that run parallel to sides 270, 272, 274, 276.

Barrier 240 includes the end cap 250. End cap 250 is T-shaped. End cap 250 is a solid piece. End cap 250 includes an outer portion 290 and an inner T-shaped portion 292. Outer portion 290 has a height and a width that is the same as the height and width of first horizontal support member 246. Outer portion 290 is rectangular in section. Inner portion 292 is T-shaped in section so as to include a pair of right angled grooves 294. Inner portion 292 includes a vertically extending pin connector receiver 296 equidistance from each of the grooves 294. Receiver 296 extends vertically through the T-shaped portion 292. Outer end portion 290 includes inner faces 298. T-shaped portion 292 includes an inner T-shaped face 300. End cap 250 further includes an outer face 297 and a horizontal axially extending bore 299. Bore 299 opens through face 297. Bore 299 receives the shaft 46 of hand wheel mechanism 44.

Barrier 240 further includes pin connector 302. Pin connector 302 includes a head and a shaft. The shaft may be threaded.

In operation, to engage the upright support member 242 in a vertical position to the first horizontal support member 244, the T-shaped section 269 of the lower end portion 256 of the upright support member 242 is slid into the T-shaped slot 282 of the first horizontal support member 246 until the inner side 264 of the T-shaped section 269 hits the closed end of the T-shaped slot 282. As the T-shaped section 269 is slid in, the slots 266, 268 engage the extensions 285 of the C-shaped section 283 of the outer end portion 278 of the first horizontal support member 246. The absolute end 257 of the upright support member 242 rides on the floor of the T-shaped slot 282. Then end cap 250 is engaged with the first horizontal support member 246. The T-shaped section 292 is slid into the open end of the T-shaped slot 282 and is further slid in until the inner face 300 of the end cap 250 abuts the outer side 262 of the T-shaped section 269 of the upright support member 242. As the end cap 250 is slid in, the grooves 294 engage the extensions 285 of the C-shaped section 283 of the first horizontal support member 246. When fully engaged, the inner faces 298 of the outer portion 290 of the end cap 250 engage the absolute end 279 of the first horizontal support member 246. When fully engaged, the vertical pin receiver 296 of the end cap 250 is vertically aligned and coaxial with pin receiver 284 of the first horizontal support member 246, and pin connector 302 is engaged in the receivers 284, 296 such that chances are minimized that end cap 250 slides out.

Barrier 240 further includes a tie 304 that is rectangular in section and is friction fit into the opening 288 of each of the first and second horizontal support members 246, 248. The first and second horizontal support members 246, 248 are pushed together until their absolute ends 281 abut each other.

If desired, each of the upright support members 242, 244 can include upper and lower telescoping sections such that upright support members 242, 244 are minimizable in height.

Figure 13A:
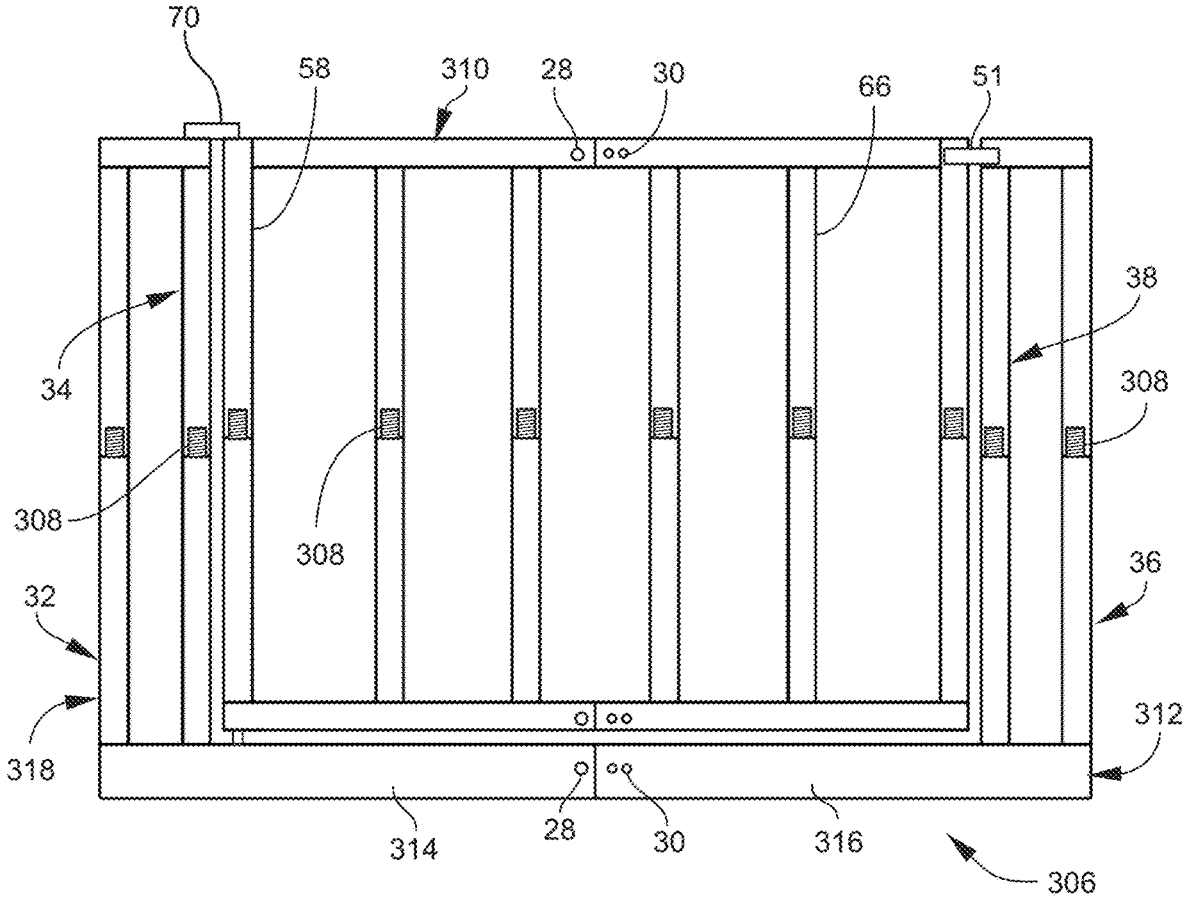
FIG. 13A is a front elevation of a tenth embodiment of a minimizable barrier, where each of the frame and gate is minimized by a threaded engagement between upper members and lower members.
Figure 13B:
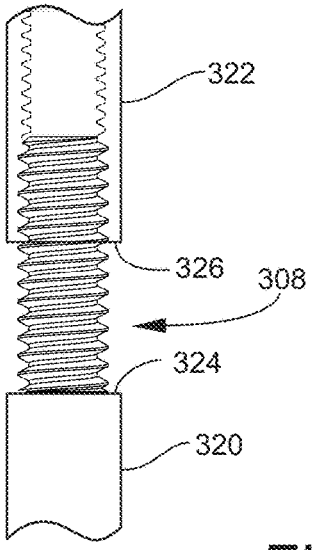
FIG. 13B is a detail view of the threaded engagement of FIG. 13A.
Figure 14:
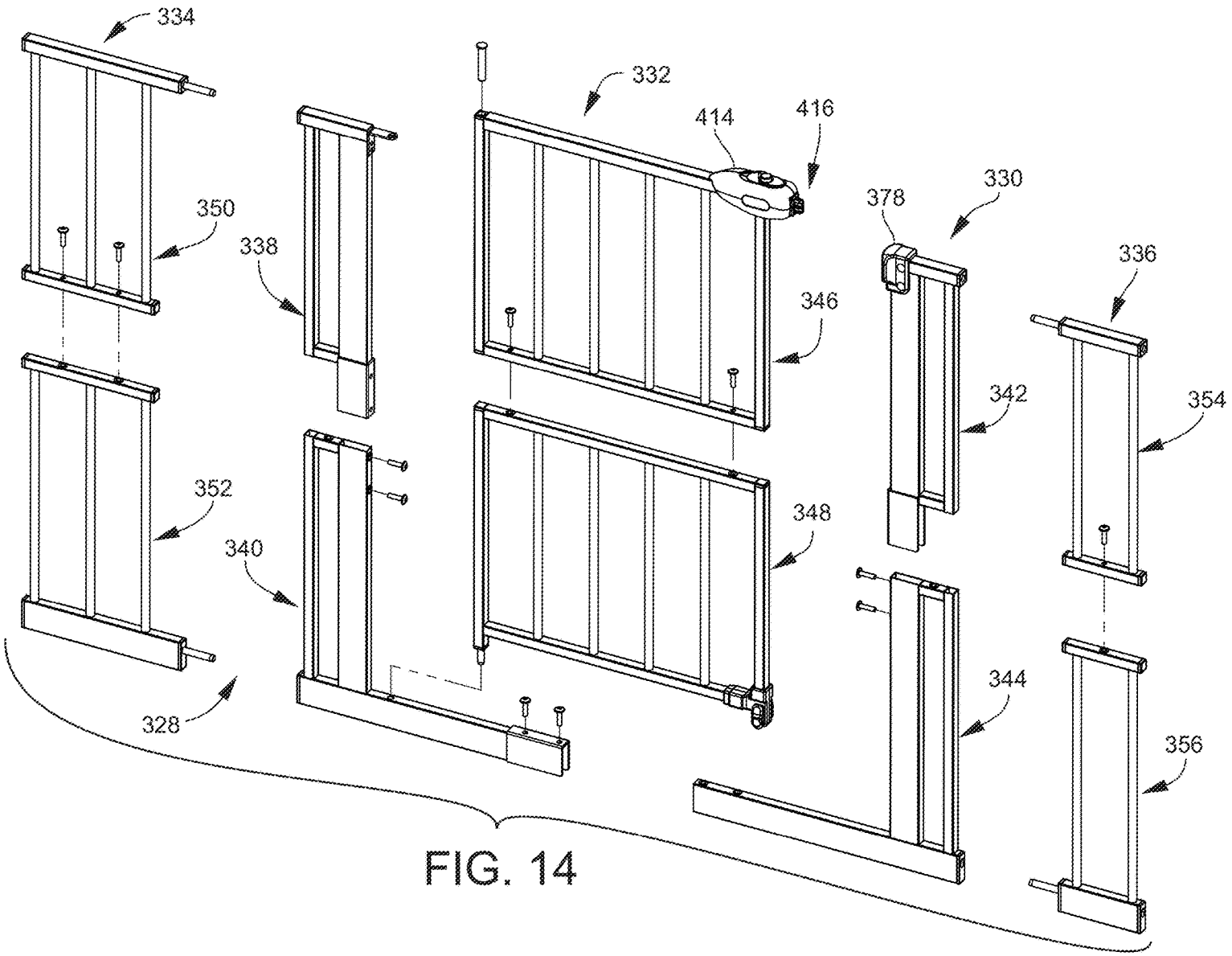
FIG. 14 is a perspective exploded view of a eleventh embodiment of a minimizable barrier having minimizable frame, a minimizable gate, and minimizable frame extensions, where each of the frame, gate and frame extensions includes an upper portion and a lower portion.
Figure 15:
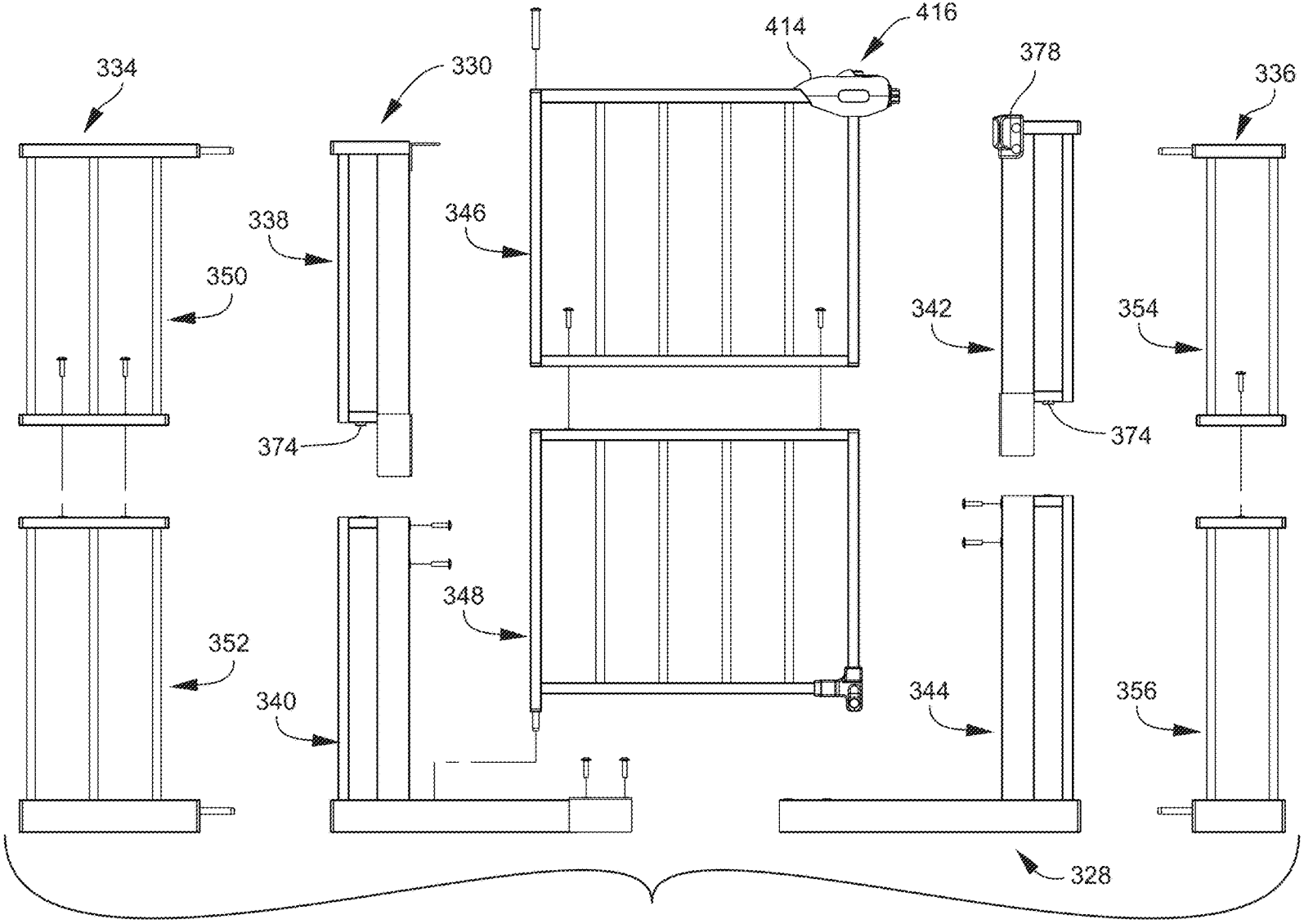
FIG. 15 is an elevation exploded view of the minimizable barrier of FIG. 14.

FIG. 13A shows an elevation view of a gate 310 and frame 318. FIG. 13B shows a detail view of a portion of the vertical support members of the frame 318 and gate 310 of FIG. 13A, where the vertical support members are reference by numbers 32, 34, 36, 38, 58, 66. The gate 310 may be separated by, for instance, a male/female arrangement or telescoping arrangement at an intermediate or middle location so as to form right hand and left hand sections for shipping and storage. The cross piece 312 may be separated by, for instance, a male/female arrangement or telescoping arrangement, so as to separate the first and second end frames from each other.

FIG. 13A shows a barrier 306. Barrier 306 is identical to barrier 10 except that barrier 306 includes threaded shaft connectors 308 on the upright support members 32, 34, 36, 38, of the barrier frame 12 instead of a pin 28 and pin hole 30 arrangement for telescoping member sections, except that barrier 306 includes the threaded shaft connectors 308 on the upright support members 58, 66 of a gate 310 instead of a pin 28 and pin hole 30 arrangement for telescoping member sections, except that gate 310 includes six upright support members 58, 66, except that a threshold telescoping cross piece 312 includes two telescoping member sections 314, 315 instead of the three threshold member sections 22, 24, 26 found in barrier 10, except that the upright support members 36, 38 of the U-shaped open top barrier frame 318 are cylindrical while the upright support members of the U-shaped open top barrier frame 12 are rectangular in section, and except that each of the upright support members of the gate 310 are cylindrical while only the interior support members of gate 14 are cylindrical.

Threaded shaft connector 308 is rigidly fixed to a lower upright support member section 320. Threaded shaft connector 308 removably engages an inner threaded bore of an upper upright support member section 322. Lower upright support member section 320 includes an upper annular face 324 and upper upright support member section 322 includes a lower annular face 326. In the fully engaged position of gate 310, faces 324, 326 abut each other. Gate 308, through the threaded shaft connector 308, is thus minimizable in the height and width direction. Gate 308, through the threaded shaft connector 308, is minimizable or reducible to four units, where each of the units includes one of an upper or lower horizontal telescoping cross piece and three upper or lower upright support member sections. Barrier frame 318 is minimizable or reducible to four units, where each of the units includes one or an upper or lower cross piece and two upper or lower upright support member sections.

The frames, i.e., the first and second end frames and cross piece, shown in any of the FIGS. 1A, 2A, 3A, 4A, 5A, 6A, 7A, 8A, 9A, 10A, 11A, and 13A may be employed with the gates shown in any of the FIGS. 1A, 2A, 3A, 4A, 5A, 6A, 7A, 8A, 9A, 10A, 11A, and 13A.

The gates of FIGS. 1A, 2A, 3A, 4A, 5A, 6A, 7A, 8A, 9A, 10A, 11A, and 13A may be pivotally engaged to the first end frame and cross piece, latchable to the second end frame, and latchable to the cross piece.

The gates of FIGS. 1A, 2A, 3A, 4A, 5A, 6A, 7A, 8A, 9A, 10A, may be pivotable to each of the first and second end frames, latchable to each other at inner end sections, and latchable to the cross piece.

Barrier 328 and units thereof are shown in FIGS. 14, 15, 16, 17A, 17B, 18, 19A, 19B, and 20. Barrier 328 includes a U-shaped open top barrier pressure frame 330, a gate 332, a first frame extension 334, and a second frame extension 336. The U-shaped open top frame 330 is minimizable or reducible to four units 338, 340, 342, and 344. The gate 332 is minimizable or reducible to two units 346 and 348. The left frame extension 334 is minimizable or reducible to two units 350 and 352. The right frame extension 336 is minimizable or reducible to two units 354 and 356. The support members making up such units, i.e., units 338, 340, 342, 344, 346, 348, 350, 352, 354, and 356, are tubular. Support members may be square in section. Support members may be rectangular in section where adjacent sides are of different lengths. Support members may be cylindrical. Support members may be oblong in section, where the oblong shape includes two spaced apart and opposing parallel sides and two spaced apart and opposing curved sides, and where the two spaced apart and opposing curved sides are circular.

Figures 17A, 17B:
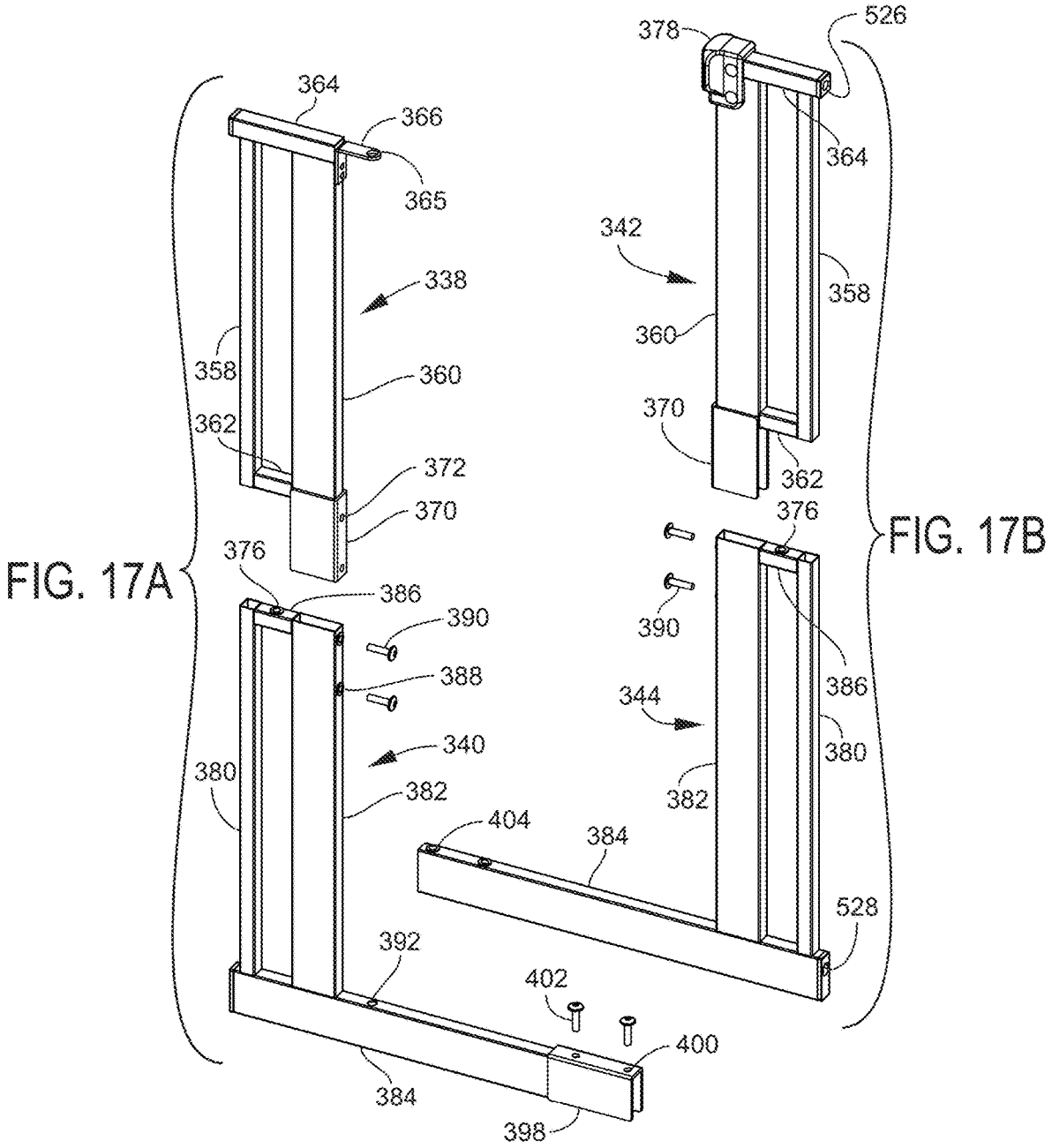
FIG. 17A is a front perspective view of the upper and lower portions of the left half of the frame of the barrier of FIG. 14.
FIG. 17B is a front perspective view of the upper and lower portions of the right half of the frame of the barrier of FIG. 14.

The four units 338, 340, 342, 344 of the U-shaped open top barrier frame 330 are shown in FIGS. 17A and 17B. Unit 338 includes an outer upright tubular support member 358, an inner upright tubular support member 360, a lower horizontal tubular support member 362, and an upper horizontal tubular support member 364. Support members 358, 360, 362, 364 define a rectangle. Support members 358, 362, 364 have square sections. Member 360 has a rectangular section. The depth or distance from front to rear of support members 358, 360, 362, 364 are the same. The width or horizontal distance from end to end of support members 358, 360 are not the same, with the width of support member 360 being greater, more than two times greater, than the width of support member 358. Support member 360 can be referred to as a standard upper portion. Unit 338 includes a right angle bracket 366. An upright portion of right angle bracket 366 is engaged to an inner end of horizontal support member 364 and is further engaged to the inner side of the upright support member 360 such that the right angle bracket 366 crosses the junction between the support members 360, 364. The distal end of the horizontal portion of right angle bracket 366 includes a pin connector hole 365 for receiving pin connector 368, shown in FIG. 18, for engaging the gate 332. If desired, a plastic decorative covering 367 may be placed over at least a portion of the right angle bracket 366.

Figure 16:
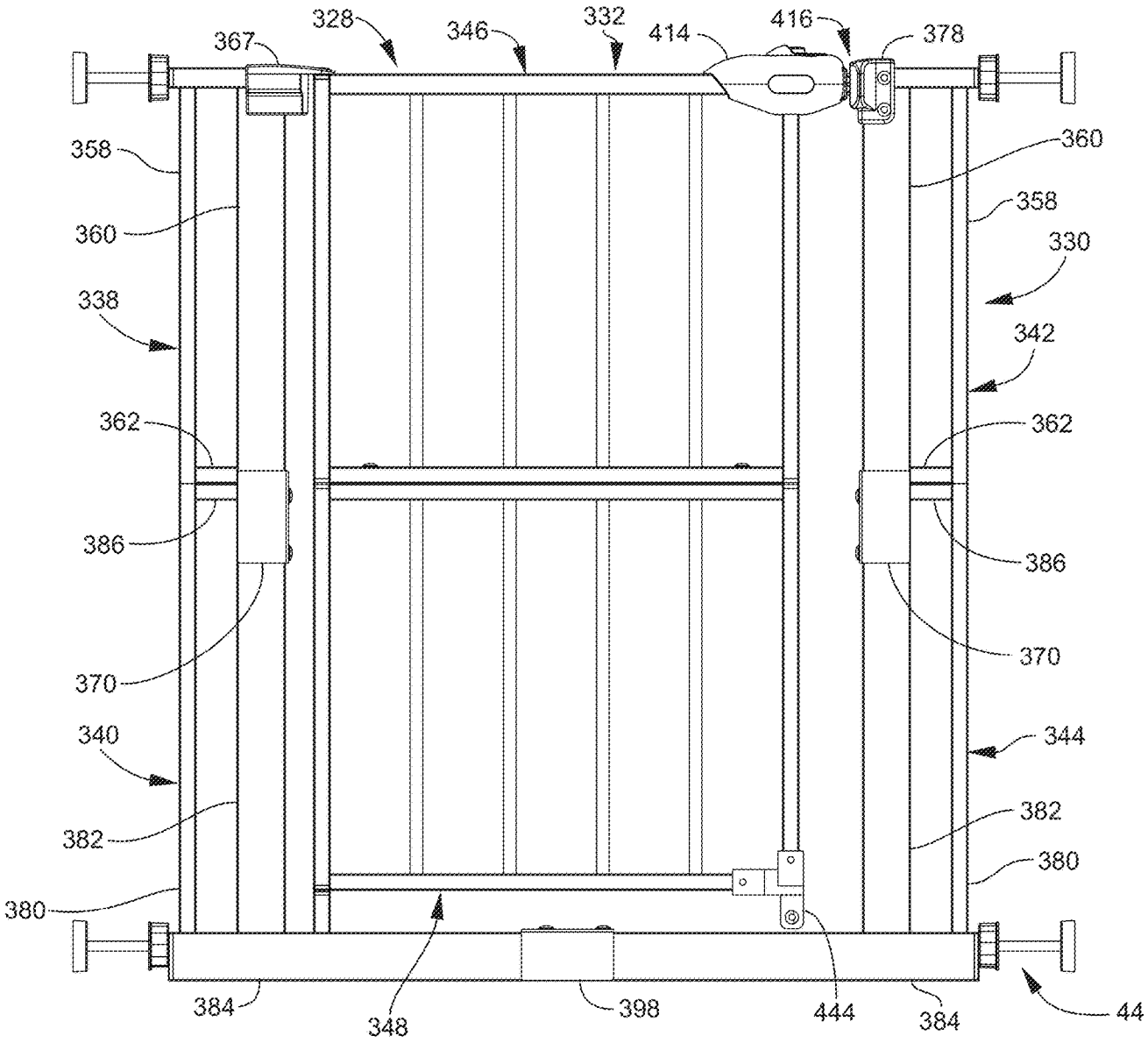
FIG. 16 is a front elevation assembled view of the minimizable barrier of FIG. 14 without the frame extensions.

Covering 367 is shown in FIG. 16. An outer end portion of upper horizontal support member 364 extends beyond a plane defined by the outer side of support member 358 and includes an axial opening or bore for receiving the shaft 46 of hand wheel mechanism 44. Unit 338 further includes a U-shaped piece 370. U-shaped piece 370 is rigidly fixed, such as by welding, to the lower end portion of inner upright support member 360 and includes a width about equal to or slightly greater than the width of upright support member 360. The additional width is provided by the inner side of U-shaped piece 370, which inner side includes two pin receptors 372. The top of the U-shaped piece 370 is disposed just short of the upper face of horizontal support member 362. The bottom of upright support member 360 is disposed between the upper pin receiver 372 and the upper edge of the U-shaped piece 370. Unit 338 further includes a locating pin 374, shown in FIG. 15, for engaging pin opening 376 on unit 340.

Unit 342 is identical to unit 338 except that unit 342 does not have the right angle bracket 366 and instead includes a latch receiver 378. Latch receiver 378 is engaged to each of the upper horizontal support member 364 and the upright support member 360. The opening in the end of the upper horizontal support member 364 for the shaft 46 of the hand wheel mechanism 44 can be seen in FIG. 17B.

Unit 340 includes an outer upright tubular support member 380, an inner upright tubular support member 382, a lower horizontal tubular support member 384 or threshold portion 384, and an upper horizontal tubular support member 386. Member 386 includes the pin receiver 376. Support members 380, 382, 384, and 386 define a rectangle, with member or threshold portion 384 extending from the defined rectangle. Support members 380 and 386 have square sections. Support members 382 and 384 have rectangular sections where adjacent sides have different widths. The depth or distance from front to rear of support members 380, 382, 384, 386 are the same. The width or horizontal distance from end to end of support members 380, 382 are not the same, with the width of support member 382 being greater, more than two times greater, than the width of support member 380. Support member 382 can be referred to as a standard upper portion. An upper inner side portion of upright horizontal support member 382 includes a pair of spaced apart pin holes or pin receivers 388 for being aligned with pin openings 372 of U-shaped piece 370 of unit 338 and for receiving pin connectors 390 so as to provide a first engagement between units 338 and 340. An upper end portion of upright horizontal member 382 is received in U-shaped portion 370 until the upper end of unit 340 abuts the lower end of unit 338 so as to provide a second engagement between units 338 and 340. Pin 374 is located in pin opening 376 to provide a third engagement between units 338 and 340. An outer end portion of lower horizontal support member 384 extends beyond a plane defined by the outer side of support member 380 and includes an axial opening or bore for receiving the shaft 46 of hand wheel mechanism 44. Lower horizontal support member 384 or threshold portion 384 includes a pin opening or pin receiver 392 for a pin 394 depending from gate 332. Pin receiver 392 and pin 394 define a swing axis 396 for gate 332. Unit 340 further includes a U-shaped piece 398. U-shaped piece 398 is rigidly fixed, such as by welding, to the inner end portion of lower horizontal support member 384 or threshold portion 384 and includes a width about equal to or slightly greater than the width of threshold portion 384. The additional width is provided by the upper side of U-shaped piece 398, which upper side includes two pin receptors 400. The inner end of horizontal support member 384 or threshold portion 384 is disposed between the outer pin receiver 400 and the outer edge of the U-shaped piece 398.

Unit 344 is identical to unit 340 except that unit 344 does not have the U-shaped piece 398 and except that unit 344 includes, and unit 340 does not include, a set of pin receivers 404. Pin receivers 404 are spaced apart from each other and are formed in the upper inner side of horizontal support member 384 or threshold portion 384 of unit 344. Pin receivers 404 are aligned with pin receivers 400 when threshold member 384 of unit 344 is engaged in U-shaped piece 398. The horizontally running bore for the shaft 46 of the hand wheel mechanism 44 is formed in the outer end of threshold portion 384 of unit 344 and can be seen in FIG. 17B.

Upright support members 380, 382 of each of units 340, 344 may be fabricated to be disposed at an oblique angle relative to their respective horizontal support member 384 or threshold portion 384 such that barrier 328 is a pressure barrier. The upright support members 382 or standard portions 382 includes respective upright axes and such upright axes are disposed obliquely and obtusely relative to the respective horizontal axes of horizontal support members 384. When threshold portions 384 are engaged to each other, the axes of threshold portions 384 define a straight line. Hand wheel mechanism 44 push in the upright support members 358, 360, 380, 382 of all units 338, 340, 342, and 344 to push the axes of such upright support members 358, 360, 380, 382 to a right angle relationship with one or more axes of threshold portions 384 of units 340, 344.

Figure 18:
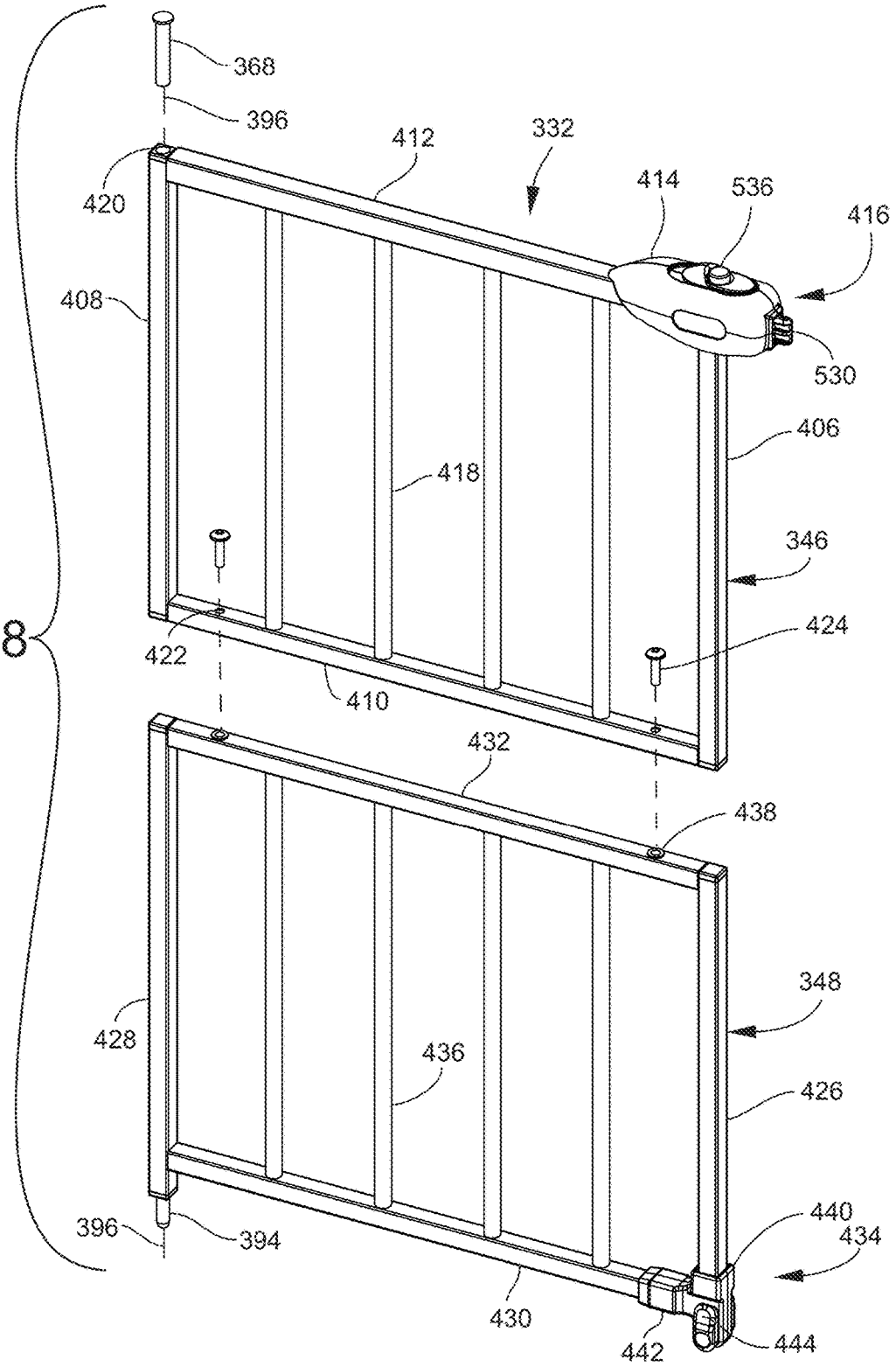
FIG. 18 is a front perspective view of the upper and lower portions of the gate of the barrier of FIG. 14.

Gate 332 of barrier 328 is shown in FIG. 18. Gate 332 includes the upper unit 346 and the lower unit 348. Unit 346 includes a latch end upright support member 406, a swing axis end upright support member 408, a lower horizontal support member 410, and an upper horizontal support member 412. Members 406, 408, 410, 412 define a rectangle having adjacent sides of different lengths. Members 406, 408, 410, 412, and a latch housing 414 define a periphery of the upper unit 346. A latch apparatus 416 includes the latch housing 414 and the latch receiver 378. Support members 406, 408 are end upright support members. Gate unit 346 includes interior upright support members 418 that are engaged to and between the lower and upper horizontal support members 410, 412. Gate 332 includes a pin receiver or pin opening 420 in the upper end portion of the swing axis end upright support member 408 for engagement of pin 368. The distal end of the horizontal portion of the right angle bracket 366 is disposed between the head of pin 368 and the upper end of swing axis end upright support member 408. Swing axis end upright support member 408 is coaxial with swing axis 396. Horizontal support member 410 includes a pair of pin through openings or pin receivers 422 that are formed in each of the upper and lower faces of the horizontal support member 410. One of the pin receivers 422 is disposed adjacent to swing axis end upright support member 408. The other of the pin receivers 422 is disposed adjacent to the latch end upright support member 406. Pin receivers 422 engage a pin connector 424. The bottom end of upright support members 406, 408 are flush or coplanar with the bottom face of horizontal support member 410.

Lower unit 348 includes a latch end upright support member 426, a swing axis end upright support member 428, a lower horizontal support member 430, and an upper horizontal support member 432. Members 426, 428, 430, 432 define a rectangle having adjacent sides of different lengths. Members 426, 428, 430, 432, and a lock 434 define a periphery of the lower unit 348. Support members 426, 428 are end upright support members. Gate unit 348 includes interior upright support members 436 that are engaged to and between the lower and upper horizontal support members 430, 432. The swing axis end upright support member 428 depends below and beyond the lower face of upright support member 430. Fixed to and depending from the bottom end of the swing axis end upright support member 428 is the pin 394 that engages the pin receiver 392 in the threshold portion 384 of the unit 340. The upper horizontal support member 432 includes a pair of pin receivers 438. One of the pin receivers 438 is adjacent to swing axis end upright support member 428. The other pin receiver 438 is adjacent to latch end upright support member 426. Pin receivers 438 line up with pin receivers 422 such that units 346, 348 are engagable to each other with pin connectors 424 that engage the pin receivers 422, 438. Pin receivers 438 are formed in the upper side or face of horizontal support member 432. The shafts of the pin connectors 424 engage an insert that has been fixed in the upper horizontal support member 432 and do not extend through the bottom side of the upper horizontal support member 432. The upper ends of upright support members 426, 428 are flush or coplanar with the upper face of the horizontal support member 432 such that units 346, 348 abut each other along the entire lengths of the upper end of lower unit 348 and the lower end of upper unit 346. Swing axis end upright support member 428 is coaxial with swing axis 396 and with swing axis end upright support member 408 of unit 346. Lock 434 includes a receptor 440 for the lower end of latch end upright support member 426 and a receptor 442 for a latch end of lower horizontal support member 430. The latch end of horizontal support member 430 may or may not engage the bottom end of latch end upright support member 426 and, if there is no such engagement, the body of lock 434 fixes the support members 426, 430 relative to each other. Lock 434 includes a pair of opposing, independently pivoting or swinging tabs 444 that can swing down to one of both of the front and rear faces of the threshold portion 384 of unit 344. The distal end of tabs 444 can swing down to an elevation that is about the elevation of the distal end of pin connector 394, which pin connector 394 extends into the threshold portion 384 of unit 340.

Figure 19A:
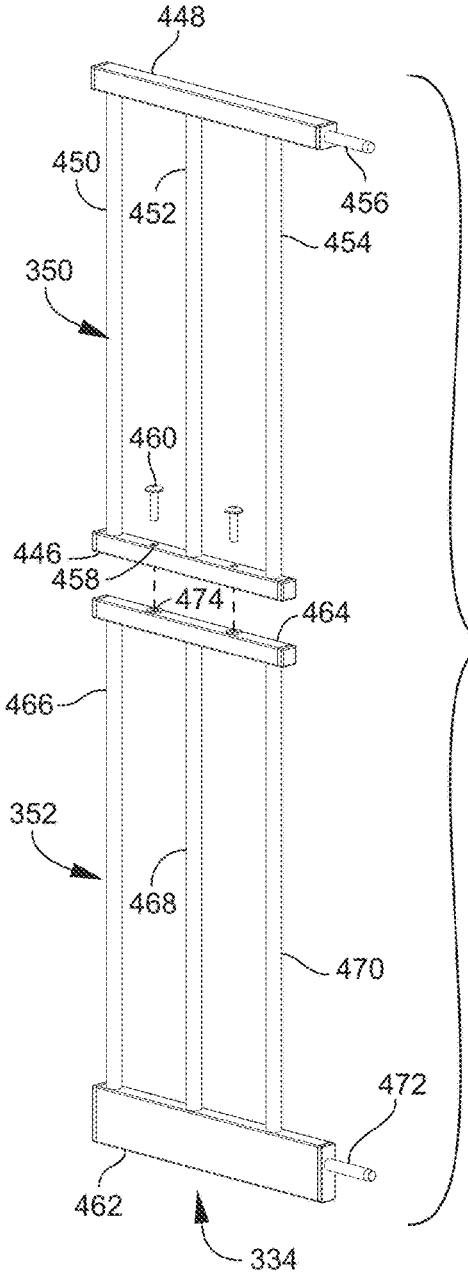
FIG. 19A is a front perspective view of the upper and lower portions of the left half frame extension of the barrier of FIG. 14.

FIG. 19A shows frame extension 334 and units 350, 352. Unit 350 includes a lower horizontal tubular support member 446, an upper horizontal tubular support member 448, an outer end upright tubular support member 450, an interior upright tubular support member 452, and an inner end upright tubular support member 454. Upright support members 450, 452, and 454 are engaged to and between lower and upper horizontal support members 446, 448. Outer end upright support member 450 is inset from the outer ends of the lower and upper horizontal support members 446, 448. Inner end upright support member 454 is inset from the inner ends of the lower and upper horizontal support members 446, 448. The outer ends of the lower and upper horizontal support members 446, 448 terminate at the same distance from outer end upright support member 450. The square sectional inner end of upper horizontal support member 448 extends further from inner end upright support member 454 than does the inner end of lower horizontal support member 446. The square sectional inner end of upper horizontal support member 448 has engaged to it a shaft or rod portion 456 extending coaxially with, inwardly of, and away from the upper horizontal support member 448. The shaft or rod portion 456 engages the bore in horizontal support member 364 of unit 338 that may be utilized by the shaft 46 of the hand wheel mechanism 44 when frame extension 334 is not employed. Lower horizontal support member 446 includes vertically extending pin receivers or pin through openings 458 for engaging pin connectors 460. A first pin receiver 458 is disposed between upright support members 450, 452. A second pin receiver 458 is disposed between upright support members 452 and 454. Lower and upper horizontal support members 446, 448 are square in section.

Figure 19B:
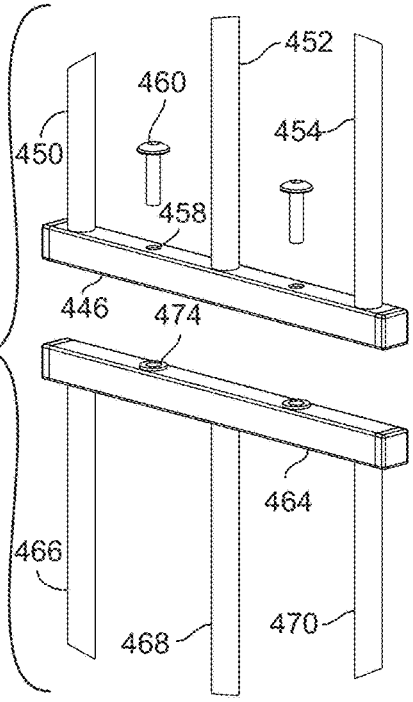
FIG. 19B is a front perspective detail view of a portion of FIG. 19B.

Unit 352 includes a lower horizontal tubular support member 462, an upper horizontal tubular support member 464, an outer end upright tubular support member 466, an interior upright tubular support member 468, and an inner end upright tubular support member 470. Upright support members 466, 468, and 470 are engaged to and between lower and upper horizontal support members 462, 464. Outer end upright support member 466 is inset from the outer ends of the lower and upper horizontal support members 462, 464. Inner end upright support member 470 is inset from the inner ends of the lower and upper horizontal support members 462, 464. The outer ends of the lower and upper horizontal support members 462, 464 terminate at the same distance from outer end upright support member 466. The rectangular sectional inner end of lower horizontal support member 462 extends further from inner end upright support member 470 than does the inner end of upper horizontal support member 464. The rectangular sectional inner end of lower horizontal support member 462 has engaged to it a shaft or rod portion 472 extending inwardly of and away from the lower horizontal support member 462. The shaft or rod portion 472 engages the bore in horizontal support member 384 of unit 340 that may be utilized by the shaft 46 of the hand wheel mechanism 44 when frame extension 334 is not employed. Upper horizontal support member 464 includes pin receivers 474 for engaging pin connectors 460. A first pin receiver 474 is disposed between axes of upright support members 466, 468. A second pin receiver 474 is disposed between axis of upright support members 468 and 470. Upper horizontal support member 464 is square in section. Lower horizontal support member 462 is rectangular in section where adjacent sides have different lengths. Shaft or rod portion 472 is disposed on an axis that lies closer to the top edge of horizontal support member 462 than the bottom edge of horizontal support member 462. FIG. 19B shows that pin connectors 460 pass through pin openings 458 that are formed in the top and bottom faces of horizontal support member 446 and then screw into threaded pin receivers 474 that are set in openings formed in the top face or top side of upper horizontal support member 464. Pin receivers 474 may be welded to upper horizontal support members 464 or be otherwise fixed to the upper horizontal support member 464.

Figure 20:
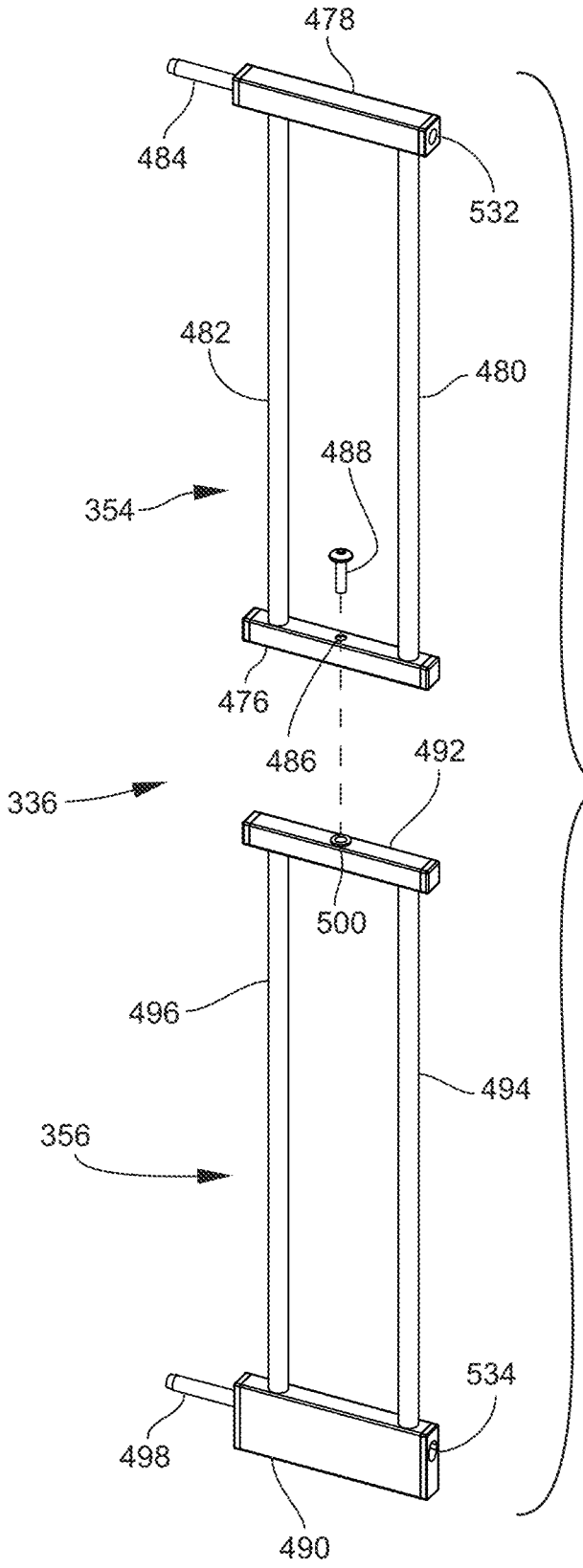
FIG. 20 is a front perspective view of the upper and lower portions of the right half frame extension of the barrier of FIG. 14.

FIG. 20 shows frame extension 336 and units 354, 356. Unit 354 includes a lower horizontal tubular support member 476, an upper horizontal tubular support member 478, an outer end upright tubular support member 480, and an inner end upright tubular support member 482. Upright support members 480 and 482 are engaged to and between lower and upper horizontal support members 476, 478. Outer end upright support member 480 is inset from the outer ends of the lower and upper horizontal support members 476, 478. Inner end upright support member 482 is inset from the inner ends of the lower and upper horizontal support members 476, 478. The outer ends of the lower and upper horizontal support members 476, 478 terminate at the same distance from outer end upright support member 480. The square sectional inner end of upper horizontal support member 478 extends further from inner end upright support member 482 than does the inner end of lower horizontal support member 476. The square sectional inner end of upper horizontal support member 478 has engaged to it a shaft or rod portion 484 extending coaxially with, inwardly of, and away from the upper horizontal support member 478. The shaft or rod portion 484 engages the bore in horizontal support member 364 of unit 342 that may be utilized by the shaft 46 of the hand wheel mechanism 44 when frame extension 336 is not employed. Lower horizontal support member 476 includes a vertically extending pin through opening 486 for engaging a pin connector 488. Pin through opening 486 is disposed between upright support members 480, 482. Lower and upper horizontal support members 476, 478 are square in section. Upright support members 480, 482 may be cylindrical, oval, or oblong in section where the oblong shape includes two spaced apart and opposing parallel sides and two spaced apart and opposing curved sides, and where the two spaced apart and opposing curved sides are circular.

As further shown in FIG. 20, unit 356 includes a lower horizontal tubular support member 490, an upper horizontal tubular support member 492, an outer end upright tubular support member 494, and an inner end upright tubular support member 496. Upright support members 494 and 496 are engaged to and between lower and upper horizontal support members 490, 492. Outer end upright support member 494 is inset from the outer ends of the lower and upper horizontal support members 490, 492. Inner end upright support member 496 is inset from the inner ends of the lower and upper horizontal support members 490, 492. The outer ends of the lower and upper horizontal support members 490, 492 terminate at the same distance from outer end upright support member 494. The rectangular sectional inner end of lower horizontal support member 490 extends further from inner end upright support member 496 than does the inner end of upper horizontal support member 492. The rectangular sectional inner end of lower horizontal support member 490 has engaged to it a shaft or rod portion 498 extending inwardly of and away from the lower horizontal support member 490. The shaft or rod portion 498 engages the bore in horizontal support member 384 of unit 344 that may be utilized by the shaft 46 of the hand wheel mechanism 44 when frame extension 336 is not employed. Upper horizontal support member 492 includes a pin receiver 500 for engaging pin connector 488. Pin receiver 500 is disposed between axes of upright support members 494, 496. Upper horizontal support member 492 is square in section. Lower horizontal support member 490 is rectangular in section where adjacent sides have different lengths. Shaft or rod portion 498 is disposed on an axis that lies closer to the top edge of horizontal support member 490 than the bottom edge of horizontal support member 490. Pin connector 488 passes through pin opening 486 that is formed in the top and bottom faces of lower horizontal support member 476. Pin connector 488 then screws into threaded pin receiver 500 that is set in an opening formed in the top face or top side of upper horizontal tubular support member 492. Pin receiver 500 may be welded to upper horizontal support member 492 or be otherwise fixed to the upper horizontal support member 492.

Figure 21:
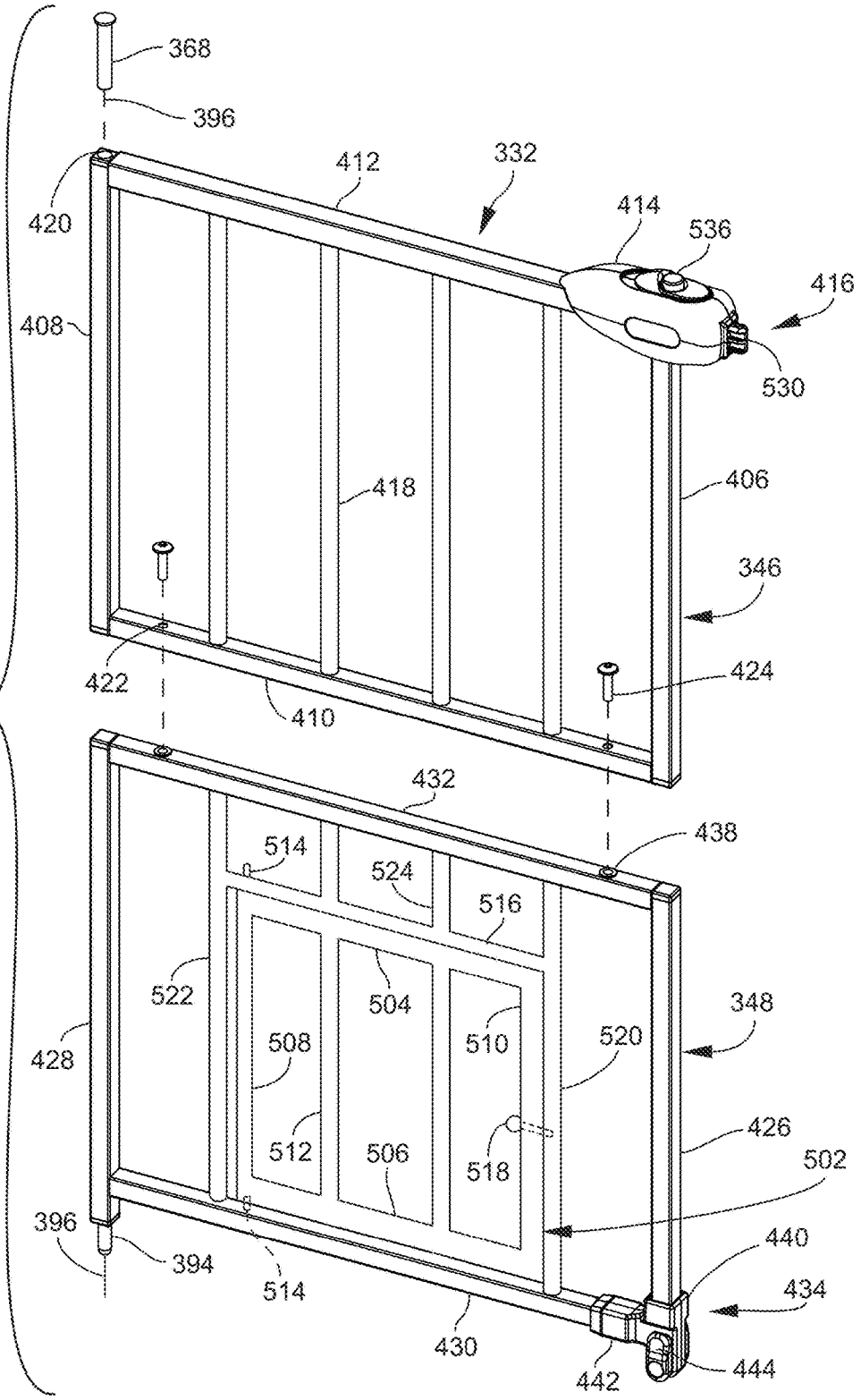
FIG. 21 is a front perspective view of an alternative embodiment of the upper and lower portions of the gate of the barrier of FIG. 14, where the alternative embodiment includes a pet door in the second and lower gate unit.

FIG. 21 shows a pet door 502 in the second gate unit 348. The pet door 502 includes an upper horizontal support member 504, a lower horizontal support member 506, a left end upright support member 508, a right end upright support member 510, and a pair of interior upright support members 512. The pet door or gate 502 is swingable on pins 514. One pin 514 engages a horizontal support member 516 of the second gate unit 348. The other pin 514 engages the lowermost horizontal support member 430 of the second gate unit 348. The pet gate 502 is swingable into and out of each of the front and rear faces of the second gate unit 348. The pet gate 502 is latchable by a latch 518 that includes a connector pin that engages the right end upright support member 510 and a right full length upright support member 520 of the second gate unit 348. Second gate unit 348 further includes a left full length upright support member 522. Second gate unit 348 further includes a pair of partial length upright support members 524 that extend from horizontal support member 516 to the uppermost horizontal support member 432. Members 512 are coaxial with members 524. Member 516 terminates at members 520 and 522. Member 516 is parallel to member 432. Member 516 is parallel to member 504 and 506. Member 432 and member 516 are parallel to member 430.

In operation, to assemble the U-shaped open top frame 330 of barrier 328, unit 338 is engaged to unit 340. This is done by sliding the upright support member 382 or standard portion 382 into the U-shaped piece or connector 370. Locator tab or pin 374 is located or placed into pin opening 376. At this point, the underside of lowermost support member 362 of unit 338 is adjacent to, confronting, and abutting the upper side of uppermost support member 386 of unit 340. Also, the underside of standard portion 360 of unit 338 is adjacent to, confronting, and abutting the upper side of the standard portion 382 of unit 340. Then the pin connectors 390 are slid through pin openings 372 and engaged with pin receivers 388. This operation is then performed with units 342 and 344. Then threshold portion 384 of unit 344 is engaged to threshold portion 384 of unit 340. This is done by sliding the inner end portion of standard portion 384 of unit 344 into the U-shaped piece 398 of unit 340 such that the absolute inner ends of the standard portions 384 of units 340, 344 are adjacent to each other, confronting each other, and abutting each other. Then pin connectors 402 are slid through pin openings 400 and engaged with pin receivers 404. At this point in time, the U-shaped open top barrier frame 330 for barrier 328 has been assembled. It should be noted that, if desired, units 340, 344 may be first engaged, and then to such result the units 338, 342 may be engaged in any order.

In operation, to assemble the gate 332 of barrier 328, units 346 and 348 are engaged to each other by placing the lowermost horizontal support member 410 of unit 346 on the uppermost horizontal support member 432 of unit 348 such that the lower side of lowermost horizontal support member 410 is adjacent to, confronting, and abutting the upper side of uppermost horizontal support member 432 of unit 348. Then pin connectors 424 are slid through pin openings 422 formed in the upper and lower sides of lowermost horizontal support member 410 and engaged in pin receivers 438 of the uppermost horizontal support member 432 of unit 426. In this result, upright support member 408 of unit 346 and upright support member 428 of unit 426 are aligned in a straight fashion such that there is one axis 396. In this result, upright support member 406 of unit 346 and upright support member 426 of unit 348 are aligned in a straight fashion such that their axis are aligned in a straight fashion and such that the outer faces of upright support members 406,426 define a single plane. Further, in this result, each of the four interior support members 418 of unit 346 are aligned in a straight fashion with their respective four interior support members 436 of unit 348 such that the axis of support members 418 are aligned in a straight fashion with the respective axis of support members 436.

In operation, to engage the assembled gate 332 to the assembled U-shaped open top frame 330 to form barrier 328 without the frame extensions 334, 336, pin 394 of unit 348 is located in pin opening 392 of the standard portion 384 of unit 340 and pin 368 is first slid through pin connector hole 365 in the distal end of bracket 366 and is then engaged with pin receiver or pin seat 420 of upright support member 408 of unit 346. If desired, the pin connector 368, after being engaged with unit 346, may rotate or pivot relative to unit 346. Or the pin connector 368 may be nonrotatably fixed to unit 346 such that rotation occurs between the pin 368 and the bracket 366. Lower pin connector 394 rotates in pin seat or pin opening 404 of unit 344.

To engage the barrier 328 without the frame extensions 334 and 336 between two vertical surfaces such as two opposing door jambs, hand wheel mechanisms 44 are utilized. The shafts 46 of four hand wheel mechanisms 44 are slid into openings 526 formed in the outer ends of horizontal support members 364 of units 338 and 342 and into openings 528 formed in the outer ends of threshold horizontal support members 384 of units 340 and 344 and the disks 50 of the hand wheel mechanisms 44 are placed against the door jambs. Then the hand wheels 48 of the hand wheel mechanisms 46 are rotated to lengthen the exposed visible portions of the shafts 46 so that the hand wheels 48 place pressure upon the assembled units 338, 340 on one side of the assembled engaged gate 332 and upon the assembled units 342, 344 on the other side of the assembled engaged gate 332. As pressure is so placed, one or more of the assembled frame ends 338, 340 and 342, 344 move toward or move into a right angle relationship with one or more of threshold portions 384 of units 340, 344. When the latch 530 of latch apparatus 416 engages latch receiver 378 such that the gate 332 may be swung open to the front or rear and such that the gate 332 may be locked relative to latch receiver 378, the barrier 328 without the frame extensions 334, 336 has been set up for operation.

To engage the barrier 328 using one or more of the frame extensions 334 and 336 between two vertical surfaces such as two opposing door jambs, the above operation using the hand wheel mechanisms 44 is employed. However, first, one or more of the frame extensions 334, 336 are engaged to one or more of units 338, 340, 342, 344 by inserting the upper pin connector 456 of unit 350 into upper pin receivers 526 of units 338, 342, by inserting the upper pin connector 484 of unit 354 into upper pin receivers 526 of units 338, 342, by inserting the lower pin connector 472 of unit 352 into lower pin receivers 528 of units 340, 344, and by inserting the lower pin connector of 498 of unit 356 into lower pin receivers 528 of units 340, 344. No frame extensions 334, 336 may be employed, one of the frame extensions 334, 336 may be employed on either of the frame ends, two frame extensions 334 may be employed where the frame extensions 334 are employed opposite sides of the frame ends and not adjacent to each other, two frame extensions 336 may be employed where the frame extensions 336 are employed opposite sides of the frame ends and not adjacent to each other, one frame extension 334 may be employed on one side and the other frame extension 336 may be employed on the other side, or a frame extension 334 may be employed adjacent to another frame extension 334 or 336, or a frame extension 336 may be employed adjacent to another frame extension 334, or there may be other combinations.

To engage frame extension units 350, 352 to each other, the lower side of lowermost horizontal member 446 of unit 350 is placed on the upper side of the uppermost horizontal member 464 of unit 352. Then pin connectors 460 are slid through pin openings 458 formed in the upper and lower sides of lowermost horizontal support member 446 and engaged in pin receivers 474 of the uppermost support member 464. This forms frame extension 334 where the axis of outer upright support members 450, 466 are aligned in a straight fashion, where the axis of interior upright support members 452, 468 are aligned in a straight fashion, where the axis of inner support members 454, 470 are aligned in a straight fashion, where the outer ends of support members 446, 464 define a plane and are adjacent to each other, and where the inner ends of support members 446, 464 define a plane and are adjacent to each other.

To engage frame extension units 354, 356 to each other, the lower side of lowermost horizontal member 476 of unit 354 is placed on the upper side of the uppermost horizontal member 492 of unit 356. Then pin connector 488 is slid through pin opening 486 formed in the upper and lower sides of lowermost horizontal support member 476 and engaged in pin receiver 500 of the uppermost support member 492. This forms frame extension 336 where the axis of outer upright support members 480, 494 are aligned in a straight fashion, where the axis of inner support members 482, 496 are aligned in a straight fashion, where the outer ends of support members 476, 492 define a plane and are adjacent to each other, and where the inner ends of support members 476, 492 define a plane and are adjacent to each other.

It should be noted that one frame extension 334 or 336 may be engaged to another frame extension 334, 336 through upper pin connectors 456, 484 of respective units 350, 354 engaging openings 532 formed in the respective outer ends of upper support members 478, 448 of uppermost horizontal support members 448, 478 of units 350, 354 and through lower pin connectors 472, 498 of respective units 352, 356 engaging openings 534 formed in respective outer ends of lower support members 462, 490 of units 352, 356. The shafts 46 of hand wheel mechanisms 44 are engaged with the openings 532, 534 in units 350, 352, 354, and 356.

The gated barrier 328 may be taken down from an operating position between two door jambs in a way opposite of, or in reverse of, the way the gated barrier 328 was set up. Then the gated barrier 328 may be disassembled opposite of the way the gated barrier 328 was assembled.

To open the gate 332, the thumb slide 536 of latch apparatus 416 is slid back to slide the latch 430 back and out of engagement with the latch receiver 378, and then the gate 332 may be swung open if one or more of locking tabs 444 have been pivoted up and out of the way of the front and rear sides and upper side of threshold portion 384 of frame unit 344.

To close the gate 332, the gate 332 may be simply swung shut without drawing back the thumb slide 536, because the spring mounted latch 530 will automatically retract after hitting oblique sides of latch receiver 378 and then automatically extend upon reaching an opening formed in latch receiver 378 between the oblique sides of the latch receiver 378. However, if desired, the gate 332 can be closed by retracting thumb slide 536 to retract latch 530 and then manually lifting off of the thumb slide 536 when the latch 530 is between such oblique sides and adjacent to such opening.

FIGS. 14-21 show a gated barrier 328 without frame extensions 334, 336 that includes: a) an open top U-shaped frame 330 having a first frame end that includes of units 338, 340, a second frame end having units 342, 344, and a cross piece made of threshold portions 384 of units 340, 344 traversing the first and second ends; b) a gate 332 in the frame 330, the gate 330 confronting the first end, the second end, and the cross piece; c) the frame 330 being reducible in each of the height and length dimension; d) the gate 332 being reducible in at least one of the height and length dimension; e) the gate 332 including a first gate unit 346 and a second gate unit 348; f) the first gate unit 346 including: i) a first lowermost traversing gate support member 410; ii) a first uppermost traversing gate support member 412; iii) a first left end upright gate support member 408; iv) a first right end upright gate support member 406; and v) at least one first interior upright gate support member 418 disposed between the first left end upright gate support member 408 and the first right end upright gate support member 406; g) the gate 332 including a second gate unit 348, the second gate unit 348 including: i) a second lowermost traversing gate support member 430; ii) a second uppermost traversing gate support member 432; iii) a second left end upright gate support member 428; iv) a second right end upright gate support member 426; and v) at least one second interior upright support member 436 disposed between the first left end upright gate support member 428 and the first right end upright gate support member 426; h) the first and second gate units 346, 348 being removably engagable to each other such that the first and second gate units 346, 348 define a plane; i) the frame 330 including a first frame unit 338, a second frame unit 340, a third frame unit 342, and a fourth frame unit 344; j) the first frame unit 338 including a first vertically extending piece 360, the first gate unit 346 being swingably engagable to the first vertically extending piece 360; k) the second frame unit 342 including a second vertically extending piece 360, the first gate unit 346 being latchably engagable to the second vertically extending piece 360; l) the third frame unit 340 including a first L-shaped piece made up of standard portion 382 and threshold portion 384, the first L-shaped piece being removably engagable to the first frame unit 338, the second gate unit 348 being swingably engagable to the third frame unit 340; and m) the fourth frame unit 344 including a second L-shaped piece made up of standard portion 382 and threshold portion 384, the second L-shaped piece being removably engagable to the first L-shaped piece of unit 340 and removably engagable to the second frame unit 348. In such gated barrier 328, the first and second gate units 346, 348 are removably engagable to each other by the first lowermost traversing gate support member 410 of the first gate unit 346 and the second uppermost traversing gate support member 432 of the second gate unit 348 being removably engagable to each other. In such gated barrier 328, the first left end upright gate support member 408 of the first gate unit 346 and the second left end upright gate support member 428 of the second gate unit 348 define a swing axis for the gate. In such gated barrier 328, the first left end upright gate support member 408 of the first gate unit 346 confronts the first frame unit 338 when the gate 332 is open and when the gate 332 is closed. In such gated barrier 328, the second left end upright gate support member 428 of the second gate unit 348 confronts the third frame unit 340 when the gate 332 is open and when the gate 332 is closed. In such gated barrier 328, the first right end upright gate support member 406 of the first gate unit 346 confronts the second frame unit 342 when the gate 332 is closed. In such gated barrier 328, the second right end upright gate support member 426 of the second gate unit 348 confronts the fourth frame unit 344 when the gate 332 is closed. In such gated barrier 328, the second lowermost traversing gate support member 430 of the second gate unit 348 confronts each of the first L-shaped piece of the third frame unit 340 and the second L-shaped piece of the fourth frame unit 344 when the gate 332 is closed. In such gated barrier 328, the gate 332 is reducible in the height dimension. In such gated barrier 328, the gated barrier 328 may further include a first frame extension 334, the first frame extension 334 including a first upper extension unit 350 and a first lower extension unit 352, the first upper and lower extension units 350, 352 being engagable to each other, the first upper extension unit 350 being engagable to the first frame unit 338, the first lower extension unit 352 being engagable to the third frame unit 340. In such gated barrier 328, the gated barrier 328 may further include a second frame extension 336, the second frame extension 336 including a second upper extension unit 354 and a second lower extension unit 356, the second upper and lower extension units 354, 356 being engagable to each other, the second upper extension unit 354 being engagable to the first frame unit 338, the second lower extension unit 356 being engagable to the third frame unit 340. In such gated barrier 328, the first vertically extending piece 360 of unit 338 is a first inner vertically extending piece 360, with the first frame unit 338 further including a first outer vertically extending piece 358, the first inner vertically extending piece 360 having a width greater than the first outer vertically extending piece 358. In such gated barrier 328, the second vertically extending piece 360 of unit 342 is a second inner vertically extending piece 360, with the second frame unit 342 further including a second outer vertically extending piece 358, the second inner vertically extending piece 360 having a width greater than the second outer vertically extending piece 358. In such gated barrier 328, the first frame unit 338 includes a first lowermost traversing frame support member 362, with the third frame unit 340 including a third uppermost traversing frame support member 386, with the first and third frame units 338, 340 being removably engagable to each other by the first lowermost traversing frame support member 362 and the third uppermost traversing frame support member 386 being removably engagable to each other. In such gated barrier 328, the second frame unit 342 includes a second lowermost traversing frame support member 362, with the fourth frame unit 344 including a fourth uppermost traversing frame support member 386, with the second and fourth frame units 342, 344 being removably engagable to each other by the second lowermost traversing frame support member 362 and the fourth uppermost traversing frame support member 386 being removably engagable to each other.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A gated barrier comprising:

a) a frame having a first end and a second end and a cross piece traversing the first and second ends; and b) a gate in the frame, the gate confronting the first end, the second end, and the cross piece;

c) the frame being reducible in each of a height dimension and a length dimension;

d) the gate being reducible in the height dimension;

e) the gate including a first gate unit and a second gate unit;

f) the first gate unit comprising:

i) a first lowermost traversing gate support member;

ii) a first uppermost traversing gate support member;

iii) a first left end upright gate support member;
iv) a first right end upright gate support member; and
v) at least one first interior upright gate support member disposed between the first left end upright gate support member and the first right end upright gate support member;

g) the second gate unit comprising:
i) a second lowermost traversing gate support member;
ii) a second uppermost traversing gate support member;
iii) a second left end upright gate support member;
iv) a second right end upright gate support member; and
v) at least one second interior upright support member disposed between the first left end upright gate support member and the first right end upright gate support member;

h) wherein the first and second gate units are removably engagable to each other such that the first and second gate units define a plane;

i) wherein the first and second gate units are removably engagable to each other by the first lowermost traversing gate support member of the first gate unit and the second uppermost traversing gate support member of the second gate unit being removably engagable to each other;

j) wherein the frame includes a first frame unit, a second frame unit, a third frame unit, and a fourth frame unit;

k) wherein the first gate unit is swingably engagable to the first frame unit;

l) wherein the first gate unit is latchably engagable to the second frame unit;

m) wherein the second gate unit is swingably engagable to the third frame unit; and n) wherein the second gate unit is latchably engagable to the fourth frame unit.

2. A gated barrier comprising:

a) a frame having a first end and a second end and a cross portion traversing the first and second ends;

b) a gate in the frame, the gate confronting the first end, the second end, and the cross portion;

c) the frame being reducible in each of a height dimension and a length dimension;

d) the gate being reducible in the height dimension;

e) the frame including a first frame unit, a second frame unit, a third frame unit, and a fourth frame unit;

f) the gate being swingably engagable to the first frame unit;

g) the gate being swingably engagable to the third frame unit;

h) the gate being latchably engagable to the second frame unit;

i) the gate being latchably engagable to the fourth frame unit;

j) the third frame unit comprising a first L-shaped portion;

k) the fourth frame unit comprising a second L-shaped portion;

l) wherein the first L-shaped portion of the third frame unit is removably engagable to the second L-shaped portion of the fourth frame unit;

m) wherein the first frame unit further comprises a first lowermost traversing frame support member, wherein the third frame unit further comprises a third uppermost traversing frame support member, and wherein the first and third frame units are removably engagable to each other by the first lowermost traversing frame support member and the third uppermost traversing frame support member being removably engagable to each other; and n) wherein the second frame unit further comprises a second lowermost traversing frame support member, wherein the fourth frame unit further comprises a fourth uppermost traversing frame support member, and wherein the second and fourth frame units are removably engagable to each other by the second lowermost traversing frame support member and the fourth uppermost traversing frame support member being removably engagable to each other.

3. A gated barrier comprising:

a) a frame having a first end and a second end and a cross portion traversing the first and second ends;

b) a gate in the frame, the gate confronting the first end, the second end, and the cross portion;

c) the frame being reducible in each of a height dimension and a length dimension;

d) the gate being reducible in the height dimension;

e) the frame including a first frame unit, a second frame unit, a third frame unit, and a fourth frame unit;

f) the gate being swingably engagable to the first frame unit;

g) the gate being swingably engagable to the third frame unit;

h) the gate being latchably engagable to the second frame unit;

i) the gate being latchably engagable to the fourth frame unit;

j) the first frame unit comprising a first vertically extending portion adjacent to the gate;

k) the second frame unit comprising a second vertically extending portion adjacent to the gate;

l) the third frame unit comprising a third vertically extending portion adjacent to the gate;

m) the fourth frame unit comprising a fourth vertically extending portion adjacent to the gate;

n) a first U-shaped piece engaging each of the first and third vertically extending portions of the first and third frame units, the first U-shaped piece being adjacent to the gate;

o) a second U-shaped piece engaging each of the second and third vertically extending portions of the second and fourth frame units, the second U-shaped piece being adjacent to the gate;

p) the third frame unit further comprising a first horizontally extending portion adjacent to the gate;

q) the fourth frame unit further comprising a second horizontally extending portion adjacent to the gate; and r) a third U-shaped piece engaging each of the first and second horizontally extending portions of the third and fourth frame units, the third U-shaped piece being adjacent to the gate.

* * * * *